US008746874B2

(12) United States Patent
Fukui et al.

(10) Patent No.: US 8,746,874 B2
(45) Date of Patent: Jun. 10, 2014

(54) MEDIUM CONVEYANCE APPARATUS, IMAGE FORMING APPARATUS AND MEDIUM CONVEYANCE METHOD

(75) Inventors: Takashi Fukui, Kanagawa-ken (JP); Atsushi Sejima, Fuchu (JP)

(73) Assignee: FUJIFILM Corporation, Tokyo (JP)

( * ) Notice: Subject to any disclaimer, the term of this patent is extended or adjusted under 35 U.S.C. 154(b) by 384 days.

(21) Appl. No.: 13/071,318

(22) Filed: Mar. 24, 2011

(65) Prior Publication Data

US 2011/0234730 A1 Sep. 29, 2011

(30) Foreign Application Priority Data

Mar. 25, 2010 (JP) ..... 2010-070288

(51) Int. Cl.

| | |
|---|---|
| ***B41J 2/01*** | (2006.01) |
| ***B41J 29/38*** | (2006.01) |
| ***B41J 13/22*** | (2006.01) |
| *B41J 11/04* | (2006.01) |
| *B41J 11/00* | (2006.01) |

(52) U.S. Cl.

CPC ..... *B41J 13/22* (2013.01); *B41J 13/223* (2013.01); *B41J 13/226* (2013.01); *B41J 11/04* (2013.01); *B41J 11/0095* (2013.01); *B41J 11/007* (2013.01); *B41J 11/0085* (2013.01)

USPC ..... 347/104; 347/16

(58) Field of Classification Search

None

See application file for complete search history.

(56) References Cited

U.S. PATENT DOCUMENTS

| | | | | | |
|---|---|---|---|---|---|
| 2,988,357 | A | * | 6/1961 | Ranger | 271/82 |
| 3,865,362 | A | * | 2/1975 | Luffy et al. | 271/82 |
| 4,014,261 | A | * | 3/1977 | Becker | 101/230 |
| 4,179,118 | A | * | 12/1979 | Huss | 271/277 |
| 4,390,176 | A | * | 6/1983 | Kato | 271/270 |
| 4,594,597 | A | * | 6/1986 | Liu et al. | 347/177 |
| 4,660,825 | A | * | 4/1987 | Umezawa | 271/276 |
| 4,824,096 | A | * | 4/1989 | Fichter et al. | 271/277 |
| 5,355,156 | A | * | 10/1994 | Balzeit et al. | 346/138 |
| 5,402,727 | A | * | 4/1995 | Matsuo et al. | 101/486 |
| 5,421,661 | A | * | 6/1995 | Aizawa et al. | 400/625 |
| 5,454,319 | A | * | 10/1995 | Park et al. | 400/485 |
| 5,771,054 | A | * | 6/1998 | Dudek et al. | 347/102 |
| 5,862,757 | A | * | 1/1999 | Hauck | 101/484 |

(Continued)

FOREIGN PATENT DOCUMENTS

| | | | |
|---|---|---|---|
| JP | 2002-292956 | A | 10/2002 |
| JP | 2009-279795 | A | 12/2009 |

*Primary Examiner* — Laura Martin

*Assistant Examiner* — Leonard S Liang

(74) *Attorney, Agent, or Firm* — Birch, Stewart, Kolasch & Birch, LLP

(57) ABSTRACT

A medium conveyance apparatus includes: a medium supporting device having a medium supporting surface which supports a rear surface of a medium opposite to a processing object surface; a gripping device which grips a leading end portion of the medium; a fastening device which fastens at least a non-gripped portion of the medium; a conveyance device which conveys the medium held by at least one of the gripping device and the fastening device to a processing region where a processing is performed to the processing object surface; and a control device which controls the gripping device such that after the gripping device has gripped the leading end portion and before the leading end portion arrives at the processing region, at least a part of the gripping device is temporarily opened and then the part of the gripping device having been opened is closed to grip the leading end portion again.

14 Claims, 17 Drawing Sheets

(56) References Cited

U.S. PATENT DOCUMENTS

| | | | | |
|---|---|---|---|---|
| 6,014,162 | A * | 1/2000 | Kerr et al. | 347/262 |
| 6,043,836 | A * | 3/2000 | Kerr et al. | 347/262 |
| 6,048,060 | A * | 4/2000 | Narushima et al. | 347/104 |
| 6,065,397 | A * | 5/2000 | Sato | 101/118 |
| 6,309,063 | B1 * | 10/2001 | Kamano et al. | 347/104 |
| 6,561,510 | B2 * | 5/2003 | Ozaki | 271/276 |
| 6,578,846 | B2 * | 6/2003 | Maul et al. | 271/277 |
| 6,622,623 | B1 * | 9/2003 | Helmstadter et al. | 101/232 |
| 6,701,840 | B2 * | 3/2004 | Hawkes | 101/409 |
| 6,715,751 | B2 * | 4/2004 | Henn | 271/82 |
| 6,746,010 | B2 * | 6/2004 | Ozaki | 271/3.21 |
| 6,912,952 | B1 * | 7/2005 | Landa et al. | 101/230 |
| 7,543,815 | B2 * | 6/2009 | Barazani et al. | 271/277 |
| 7,909,454 | B2 * | 3/2011 | Koto et al. | 347/104 |
| 8,162,427 | B2 * | 4/2012 | Fukui | 347/16 |
| 8,172,391 | B2 * | 5/2012 | Fukui | 347/104 |
| 2002/0084581 | A1 | 7/2002 | Schaum | |
| 2008/0029951 | A1 * | 2/2008 | Dobrindt et al. | 271/178 |
| 2009/0035046 | A1 * | 2/2009 | Belbey et al. | 400/630 |
| 2009/0290008 | A1 | 11/2009 | Fukui | |
| 2010/0165033 | A1 * | 7/2010 | Fukui | 347/16 |
| 2011/0025807 | A1 * | 2/2011 | Fukui | 347/104 |
| 2011/0043563 | A1 * | 2/2011 | Houjou | 347/16 |
| 2011/0205321 | A1 * | 8/2011 | Kobayashi et al. | 347/102 |

* cited by examiner

MEDIUM CONVEYANCE APPARATUS, IMAGE FORMING APPARATUS AND MEDIUM CONVEYANCE METHOD

BACKGROUND OF THE INVENTION

1. Field of the Invention

The present invention relates to a medium conveyance apparatus, an image forming apparatus and a medium conveyance method, and more particularly to medium fastening technology for conveying a medium in a prescribed direction while maintaining the attitude of the medium.

2. Description of the Related Art

A general image forming apparatus known in the related art is an inkjet recording apparatus which forms a desired image on a recording medium by ejecting color inks from nozzles of an inkjet head while conveying a fastened recording medium in a prescribed conveyance direction.

In general, in order to form images of high definition, it is necessary for the inkjet head and the recording medium to be situated in closest possible proximity during image formation. However, if the recording medium makes contact with the inkjet head due to the inkjet head and the recording medium being situated in close proximity, then not only does the recording medium become soiled, but the inkjet head may also be damaged. Therefore, in order to prevent contact between the recording medium and the inkjet head, an extremely small throw distance of several millimeters or less is provided between the inkjet head and the recording medium.

On the other hand, when the recording medium passes directly below the inkjet head, if the recording medium or the structure arranged on a recording medium supporting surface make contact with a nozzle face of the inkjet head, then a liquid repelling film formed on the nozzle face is damaged, foreign matter adheres to the vicinity of the nozzles, and the ink ejection performance declines. It is then necessary to convey the recording medium in such a manner that the nozzle face and the recording medium, and the like, do not make contact.

Japanese Patent Application Publication No. 2009-279795 discloses a composition in which a recording medium is conveyed in a state where the leading end portion thereof is gripped by a gripper arranged on a conveyance drum. In this composition, by gripping the leading end portion of the recording medium by means of the gripper, the leading end portion of the recording medium is prevented from bending to become in contact with the nozzle face, and furthermore, by disposing the gripper to the inner side of the circumferential surface of the conveyance drum, the gripper is prevented from becoming in contact with the nozzle face.

However, when the leading end portion of the recording medium is held by a holding member, such as the gripper, and a portion other than the leading end portion of the recording medium is fastened on the circumferential surface of the conveyance drum by an air suction method, or the like, then the recording medium may be conveyed in a distorted state in the leading end portion of the recording medium, or at the boundary between the leading end portion and the other portions of the recording medium. Due to the occurrence of distortion of this kind in the recording medium, there is a high possibility of the recording medium making contact with the nozzle face.

If a gripper is disposed to the inner side of the circumferential surface of the conveyance drum, as in the composition disclosed in Japanese Patent Application Publication No. 2009-279795, then distortion is liable to occur when the portions other than the leading end portion are caused to adhere tightly to the circumferential surface of the conveyance drum by a pressing roller, or the like, after the leading end portion of the recording medium has been gripped by a gripper. In particular, marked distortion appears when using a recording medium of large thickness.

Japanese Patent Application Publication No. 2002-292956 discloses a conveyance drum type conveyance apparatus equipped with a holding device that holds a front edge of cut sheet of printing paper in a printing unit having a NIP (non-impact printing) head. This holding device is composed in such a manner that when printing paper is received from a paper supply drum, the front edge of the cut sheet of printing paper is held between a clamp jaw aligned in parallel with the axial direction of the conveyance drum and the front edge of a cut sheet supporting surface, and when the holding device approaches the NIP printing head, a pressing hook device opens and the clamp jaw is moved inside the conveyance drum, so as to prevent interference between the NIP printing head and the clamp jaw. With this composition, however, the holding mechanism of the leading end portion of the recording medium is opened before the recording medium enters directly below the NIP printing head (inkjet head), and therefore the recording medium becomes significantly separated due to the occurrence of floating up in the leading end portion of the recording medium, and there is a raised possibility of contact between the recording medium and the nozzle face.

SUMMARY OF THE INVENTION

The present invention has been contrived in view of these circumstances, an object thereof being to provide a medium conveyance apparatus, an image forming apparatus and a medium conveyance method whereby floating of the medium can be suppressed by eliminating distortion during conveyance of the medium which is the object of processing.

In order to attain the aforementioned object, the present invention is directed to a medium conveyance apparatus, comprising: a medium supporting device having a medium supporting surface which supports a rear surface of a medium opposite to a processing object surface of the medium; a gripping device which grips a leading end portion of the medium in terms of a conveyance direction of the medium; a fastening device which fastens at least a non-gripped portion of the medium other than the leading end portion, the non-gripped portion being not gripped by the gripping device; a conveyance device which conveys the medium held by at least one of the gripping device and the fastening device, in the conveyance direction to a processing region where a processing is performed to the processing object surface of the medium; and a control device which controls the gripping device in such a manner that after the gripping device has gripped the leading end portion of the medium and before the leading end portion of the medium arrives at the processing region, at least a part of the gripping device is temporarily opened and then after a prescribed time period has elapsed, the part of the gripping device having been opened is closed to grip the leading end portion of the medium again.

According to this aspect of the present invention, floating up of the medium from the medium supporting surface is suppressed by releasing distortion produced in the vicinity of the leading end portion of the medium when the medium is fastened on the medium supporting surface, and therefore the medium is conveyed in a state of tight contact with the medium supporting surface.

The mode of the medium conveyance apparatus in the present invention may employ various conveyance methods, such as a belt conveyance method or a drum conveyance method.

Preferably, the fastening device includes a suction fastening device which fastens the medium by suction by generating a negative pressure at the medium supporting surface.

According to this aspect of the present invention, it is possible to fasten the medium reliably on the medium supporting surface, and desirable conveyance of the medium is achieved.

In this mode, it is possible to arrange a plurality of suction holes in the medium supporting surface and to generate a suction pressure by means of an externally arranged pressure generating device through a flow channel connected to the suction holes.

Preferably, the fastening device includes a pressure application device which fastens the medium by applying pressure to the processing object surface of the medium.

The pressure application device according to this mode may employ a contact method which applies the pressure by making contact with the processing object surface of the medium, or a non-contact method which applies the pressure without making contact with the processing object surface of the medium. One mode of the non-contact method is a mode where an air flow is blown onto the processing object surface of the medium.

Preferably, the medium conveyance apparatus further comprises: a medium detection device which detects floating up of the medium entering into the processing region at a detection region on an upstream side of the processing region in terms of the conveyance direction of the medium, wherein the control device controls the gripping device in such a manner that the part of the gripping device having been opened starts to be closed before entering into the detection region.

According to this aspect of the present invention, by setting the medium to the same attitude as during processing, before detection of floating of the medium, it is possible reliably to detect change in the state of the medium caused by opening and closing of the gripping device. Furthermore, it is possible to prevent the open state of the gripping device being detected erroneously as floating of the medium.

In this case, a desirable mode is one where the gripping device is controlled in such a manner that the gripping device finishes closing before the medium leaves the detection region of the medium detection device.

Preferably, the gripping device includes a gripper having a structure that does not project outward beyond the medium supporting surface.

In this case, a mode is possible in which a plurality of grippers are arranged through a length corresponding to the maximum width of the medium, in the widthwise direction of the medium (the direction substantially perpendicular to the conveyance direction).

Preferably, the gripping device includes a plurality of grippers aligned in a widthwise direction of the medium which is perpendicular to the conveyance direction of the medium; and the control device controls the gripping device in such a manner that when the part of the gripping device is temporarily opened, an amount of opening of the gripper corresponding to substantially center of the recording medium in the widthwise direction is smaller than an amount of opening of the grippers corresponding to ends of the recording medium in the widthwise direction.

According to this aspect of the present invention, distortion is eliminated by opening the grippers in either end portion in the widthwise direction of the medium where distortion is liable to occur, whereas fastening of the medium is maintained in the central portion in the widthwise direction of the medium, thereby preventing positional displacement of the medium.

A desirable mode is one where the amount of opening of the grippers in the central portion is less than the thickness of the medium and the amount of opening of the grippers in either end portion exceeds the thickness of the medium.

Preferably, the control device controls the fastening device in such a manner that a fastening force of the fastening device acting on the recording medium is weakened while the part of the gripping device is being temporarily opened.

According to this aspect of the present invention, distortion is eliminated in a broad range of the medium.

In this case, a desirable mode is one where the suction pressure is weakened only in the leading end portion of the medium where distortion is liable to occur and the suction pressure is maintained in the portions other than the leading end portion of the medium, where distortion is not liable to occur.

Preferably, the conveyance device includes a pressure drum of a cylindrical shape configured to be rotatable in a state where the medium is fastened on an outer circumferential surface of the cylindrical shape.

According to this aspect of the present invention, in the pressure drum conveyance method in which floating up of the medium due to distortion is liable to occur, it is possible effectively to suppress floating of the medium caused by distortion of the medium.

In order to attain the aforementioned object, the present invention is also directed to an image forming apparatus, comprising: an image forming device which forms an image on an image forming surface of a medium; a medium supporting device having a medium supporting surface which supports a rear surface of the medium opposite to the image forming surface of the medium; a gripping device which grips a leading end portion of the medium in terms of a conveyance direction of the medium; a fastening device which fastens at least a non-gripped portion of the medium other than the leading end portion, the non-gripped portion being not gripped by the gripping device; a conveyance device which conveys the medium held by at least one of the gripping device and the fastening device, in the conveyance direction to an image forming region where the image forming device forms the image on the image forming surface of the medium; and a control device which controls the gripping device in such a manner that after the gripping device has gripped the leading end portion of the medium and before the leading end portion of the medium arrives at the image forming region, at least a part of the gripping device is temporarily opened and then after a prescribed time period has elapsed, the part of the gripping device having been opened is closed to grip the leading end portion of the medium again.

The image forming apparatus according to this aspect of the present invention includes an inkjet recording apparatus equipped with an inkjet head as the image forming device.

In order to attain the aforementioned object, the present invention is also directed to a medium conveyance method, comprising the steps of: conveying a medium in a conveyance direction in a state where the medium is fastened; gripping a leading end portion of the medium in terms of the conveyance direction in the conveying step; fastening at least a portion of the medium other than the leading end portion of the medium of which the leading end portion is being gripped; then releasing the gripping with respect to at least a part of the leading end portion of the medium which has been gripped; and then gripping the leading end portion of the medium again after a prescribed period of time has elapsed since the releasing in the releasing step.

One example of the fastening step includes a mode where the medium is fastened by generating negative pressure to act on the medium from the medium supporting surface. Furthermore, a desirable mode is one including a pressure application step of fastening the medium by applying pressure to the processing object surface of the medium.

Moreover, a desirable mode is one including a detection step of detecting a position of the medium on a conveyance path and a switching step of selectively switching gripping and releasing of the gripping of the leading end portion of the medium, in accordance with the detected position of the medium.

According to the present invention, floating up of the medium from the medium supporting surface is suppressed by releasing distortion produced in the vicinity of the leading end portion of the medium when the medium is fastened on the medium supporting surface, and therefore the medium is conveyed in a state of tight contact with the medium supporting surface.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 2 is a perspective diagram showing the structure of an image formation drum in

FIG. 1;

DETAILED DESCRIPTION OF THE PREFERRED EMBODIMENTS

General Composition of Inkjet Recording Apparatus

Figure 1:
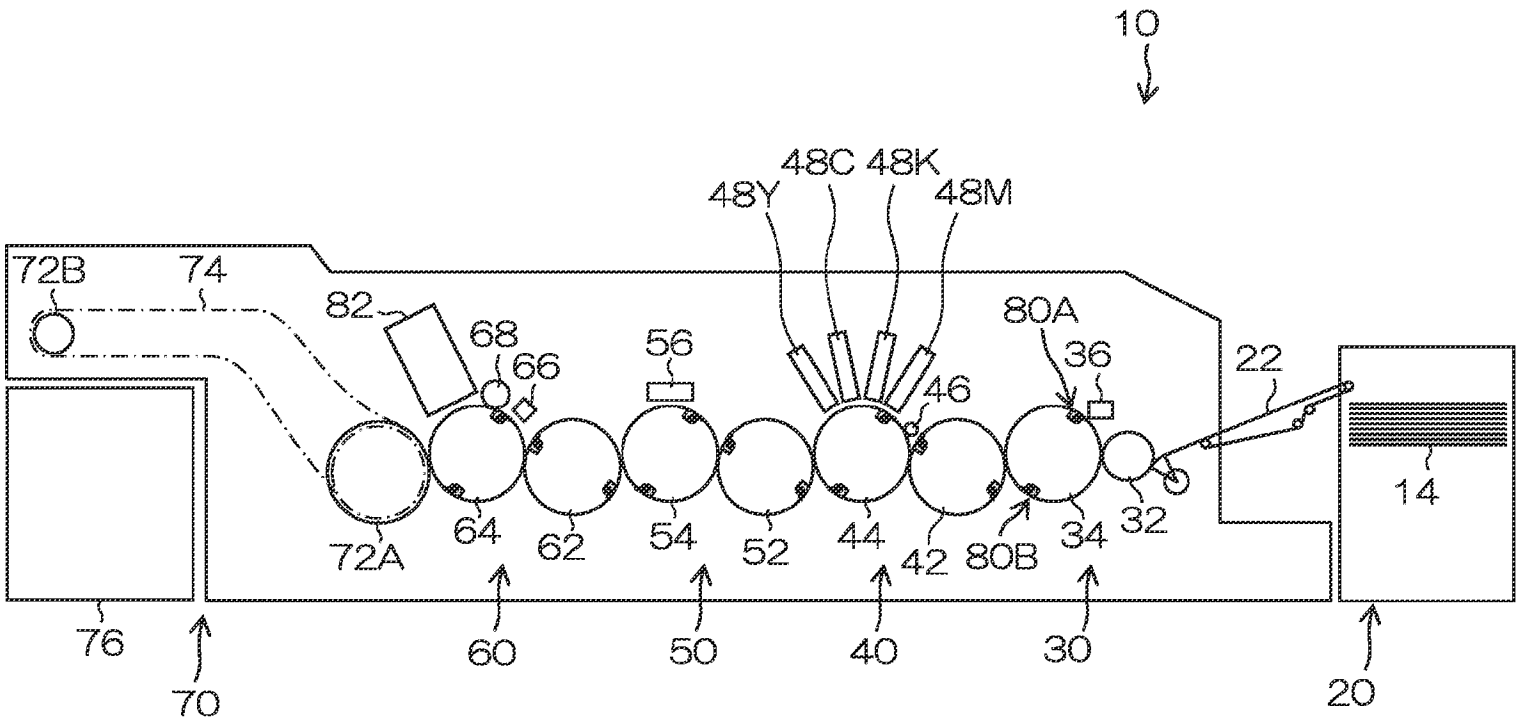
FIG. 1 is a general schematic drawing of an inkjet recording apparatus to which a medium conveyance apparatus according to an embodiment of the present invention is applied.

FIG. 1 is a schematic drawing showing the general composition of an inkjet recording apparatus according to an embodiment of the present invention. The inkjet recording apparatus 10 shown in FIG. 1 is a recording apparatus based on a two-liquid aggregation system which forms an image on a recording surface of a recording medium 14 on the basis of prescribed image data, by using ink containing coloring material and an aggregating treatment liquid having a function of aggregating the ink.

The inkjet recording apparatus 10 includes a paper feed unit 20, a treatment liquid application unit 30, an image formation unit 40, a drying process unit 50, a fixing process unit 60 and an output unit 70. Transfer drums 32, 42, 52 and 62 are arranged as devices which receive and transfer a recording medium 14 conveyed respectively from stages prior to the treatment liquid application unit 30, the image formation unit 40, the drying process unit 50, and the fixing process unit 60. Pressure drums 34, 44, 54 and 64 are arranged as devices for holding and conveying the recording medium 14 respectively in the treatment liquid application unit 30, the image formation unit 40, the drying process unit 50 and the fixing process unit 60.

Grippers 80A and 80B, which grip and hold the leading end portion of the recording medium 14, are arranged on each of the transfer drums 32, 42, 52 and 62 and the pressure drums 34, 44, 54 and 64. The grippers 80A and 80B adopt a common structure for gripping and holding the leading end portion of the recording medium 14 and for transferring the recording medium 14 to the grippers arranged in another pressure drum or transfer drum, and the grippers 80A and 80B are disposed in symmetrical positions separated by 180° in the direction of rotation of each drum on the outer circumferential surface of each drum.

When each of the transfer drums 32, 42, 52 and 62 and the pressure drums 34, 44, 54 and 64 rotates in a prescribed rotational direction in a state where the leading end portion of the recording medium 14 is gripped with the grippers 80A or the grippers 80B, the recording medium 14 is rotated and conveyed following the outer circumferential surface of each drum. In FIG. 1, reference numerals are only provided to the grippers 80A and 80B arranged in the pressure drum 34, and reference numerals to the grippers in the other pressure drums and transfer drums are omitted.

When the recording medium (cut sheet of paper) 14 accommodated in the paper feed unit 20 is supplied to the treatment liquid application unit 30, an aggregating treatment liquid (hereinafter, simply referred to as "treatment liquid") is applied to the recording surface of the recording medium 14 held on the outer circumferential surface of the pressure drum 34. The "recording surface" of the recording medium 14 is the outer surface when the medium is held by the pressure drums 34, 44, 54 and 64, this being the surface opposite to the surface held on the pressure drums 34, 44, 54 and 64.

Thereupon, the recording medium 14 on which the treatment liquid has been deposited is sent to the image formation unit 40, and colored ink is deposited by the image formation unit 40 onto the area of the recording surface where the treatment liquid has been deposited, thereby forming a desired image.

The recording medium 14 on which the desired image has been formed with the colored inks is sent to the drying process unit 50, and a drying process is carried out by the drying process unit 50. Then, the recording medium 14 is conveyed to the fixing process unit 60 after the drying process and a fixing process is carried out. By carrying out the drying process and the fixing process, the image formed on the recording medium 14 is made durable. Thus, the desired image is formed on the recording surface of the recording medium 14, and after fixing the image on the recording surface of the recording medium 14, the recording medium 14 is conveyed to the exterior of the apparatus from the output unit 70.

The respective units of the inkjet recording apparatus 10 (paper feed unit 20, treatment liquid application unit 30, image formation unit 40, drying process unit 50, fixing process unit 60 and output unit 70) are described in detail below.

<Paper Feed Unit>

The paper feed unit 20 includes a paper feed tray 22 and a paying out mechanism (not illustrated) and is composed so as to pay out the recording medium 14 one sheet at a time from the paper feed tray 22. The recording medium 14 paid out from the paper feed tray 22 is registered in position by a guide member (not illustrated) in such a manner that the leading end portion is disposed at the position of the grippers (not illustrated) on the transfer drum (paper feed drum) 32.

<Treatment Liquid Application Unit>

The treatment liquid application unit 30 includes the pressure drum (treatment liquid drum) 34, which holds, on the outer circumferential surface thereof, the recording medium 14 transferred from the paper feed drum 32 and conveys the recording medium 14 in the prescribed conveyance direction, and a treatment liquid application unit 36, which applies treatment liquid to the recording surface of a recording medium 14 held on the outer circumferential surface of the treatment liquid drum 34. When the treatment liquid drum 34 is rotated in the counter-clockwise direction in FIG. 1, the recording medium 14 is conveyed so as to rotate in the counter-clockwise direction following the outer circumferential surface of the treatment liquid drum 34.

The treatment liquid application unit 36 shown in FIG. 1 is arranged at a position facing the outer circumferential surface (recording medium holding surface) of the treatment liquid drum 34. One example of the composition of the treatment liquid application unit 36 is a mode including a treatment liquid vessel, which stores the treatment liquid, an uptake roller, which is partially immersed in the treatment liquid in the treatment liquid vessel and which takes up the treatment liquid in the treatment liquid vessel, and an application roller (rubber roller), which moves the treatment liquid taken up by the uptake roller, onto the recording medium 14.

A desirable mode is one which including an application roller movement mechanism, which moves the application roller in the upward and downward direction (the normal direction with respect to the outer circumferential surface of the treatment liquid drum 34), so as to be able to avoid collisions between the application roller and the grippers 80A and 80B.

The treatment liquid deposited on the recording medium 14 by the treatment liquid application unit 30 contains a coloring material aggregating agent, which aggregates the coloring material (pigment) in the ink deposited by the image formation unit 40, and when the treatment liquid and the ink come into contact with each other on the recording medium 14, the separation of the coloring material and the solvent in the ink is promoted.

Desirably, the treatment liquid application unit 30 doses the amount of treatment liquid applied to the recording medium 14 while applying the treatment liquid, and desirably, the thickness of the film of treatment liquid on the recording medium 14 is sufficiently smaller than the diameter of the ink droplets which are deposited by the image formation unit 40.

<Image Formation Unit>

The image formation unit 40 includes the pressure drum (image formation drum) 44, which holds and conveys the recording medium 14, a paper pressing roller 46 for causing the recording medium 14 to adhere tightly to the image formation drum 44, and inkjet heads 48M, 48K, 48C and 48Y, which eject droplets of the ink toward the recording medium 14.

Figure 2:
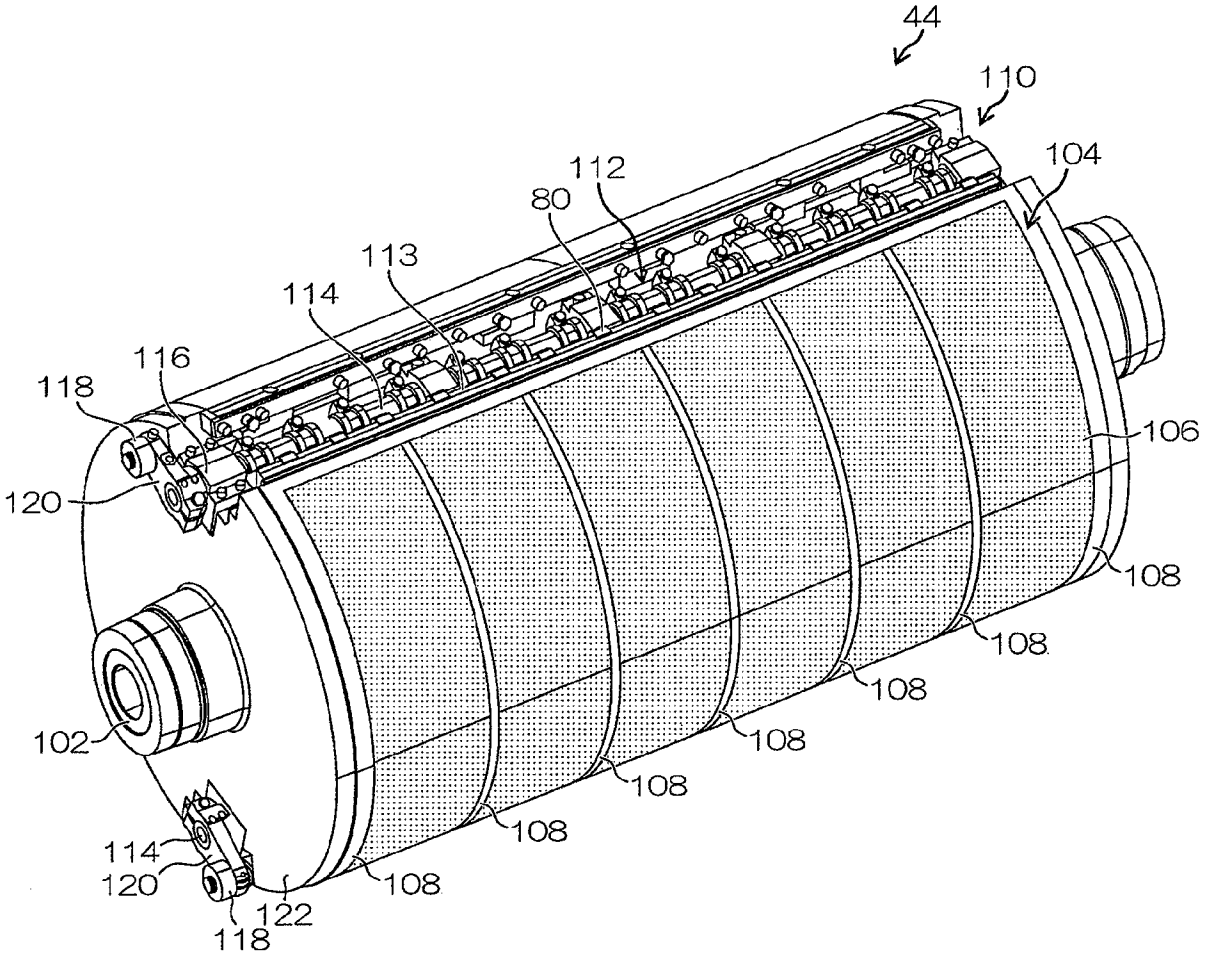

The basic structure of the image formation drum 44 is the same as that of the treatment liquid drum 34, but the grippers 80A and 80B, which grip the leading end portion of the recording medium 14, are structurally different in that they are disposed so as not to project beyond the circumferential surface 104 (see FIG. 2). A detailed description of the image formation drum 44 is given below.

The paper pressing roller 46 is a guide member for causing the recording medium 14 to make tight contact with the outer circumferential surface of the image formation drum 44, and is disposed facing the outer circumferential surface of the image formation drum 44, to the downstream side of the transfer position of the recording medium 14 between the transfer drum 42 and the image formation drum 44 and to the upstream side of the inkjet heads 48M, 48K, 48C and 48Y, in terms of the conveyance direction of the recording medium 14.

A paper floating detection sensor 126 (not shown in FIG. 1, and shown in FIG. 3) is arranged between the paper pressing roller 46 and the inkjet head 48Y on the furthest upstream side in terms of the conveyance direction of the recording medium 14. The paper floating detection sensor determines the amount of floating of the recording medium 14 immediately before the recording medium 14 enters directly below the inkjet heads 48M, 48K, 48C and 48Y. The inkjet recording apparatus 10 shown in the present embodiment is composed in such a manner that a notification is issued and conveyance of the recording medium 14 is interrupted, if the amount of floating of the recording medium 14 as determined by the paper floating detection sensor exceeds a prescribed threshold value.

When the recording medium 14 which has been transferred from the transfer drum 42 to the image formation drum 44 is conveyed to rotate in a state where the leading end is held by the grippers (reference numeral omitted), the recording medium 14 is pressed by the paper pressing roller 46 and is caused to make tight contact with the outer circumferential surface of the image formation drum 44. After the recording medium 14 has been caused to make tight contact with the outer circumferential surface of the image formation drum 44 in this way, the recording medium 14 is passed to a printing region directly below the inkjet heads 48M, 48K, 48C and 48Y, without any floating up of the recording medium 14 from the outer circumferential surface of the image formation drum 44.

The inkjet heads 48M, 48K, 48C and 48Y respectively correspond to inks of the four colors of magenta (M), black (K), cyan (C) and yellow (Y), and are disposed in this order from the upstream side in terms of the direction of rotation of the image formation drum 44 (the counter-clockwise direction in FIG. 1). The ink ejection faces (nozzle faces) of the inkjet heads 48M, 48K, 48C and 48Y are disposed so as to face the recording surface of the recording medium 14 held on the image formation drum 44. Here, the "ink ejection faces (nozzle faces)" are surfaces of the inkjet heads 48M, 48K, 48C and 48Y which face the recording surface of the recording medium 14, and are the surfaces where the nozzles which eject ink as described below are formed (these nozzles are denoted with reference numeral 208 in FIG. 13).

Each of the inkjet heads 48M, 48K, 48C and 48Y shown in FIG. 1 is disposed at an inclination with respect to the horizontal plane in such a manner that the nozzle face of each of the inkjet heads 48M, 48K, 48C and 48M is substantially parallel to the recording surface of the recording medium 14 held on the outer circumferential surface of the image formation drum 44.

The inkjet heads 48M, 48K, 48C and 48Y are full line heads having a length corresponding to the maximum width of the image forming region on the recording medium 14 (the length of the recording medium 14 in the direction perpendicular to the conveyance direction), and are fixed so as to extend in a direction perpendicular to the conveyance direction of the recording medium 14.

The nozzles for ejecting the ink are formed in a matrix configuration throughout the whole width of the image forming region of the recording medium 14 on the nozzle faces (liquid ejection faces) of the inkjet heads 48M, 48K, 48C and 48Y.

When the recording medium 14 is conveyed to a printing region directly below the inkjet heads 48M, 48K, 48C and 48Y, droplets of the inks of respective colors are ejected on the basis of image data, from the inkjet heads 48M, 48K, 48C and 48Y toward the region of the recording medium 14 where the aggregating treatment liquid has been deposited.

When the droplets of the colored inks are ejected from the corresponding inkjet heads 48M, 48K, 48C and 48Y toward the recording surface of the recording medium 14 held on the outer circumferential surface of the image formation drum 44, the ink makes contact with the treatment liquid on the recording medium 14, and an aggregating reaction occurs with a coloring material (pigment-based coloring material) which is dispersed in the ink or a coloring material (dye-based coloring material) which can be insolubilized, thereby forming an aggregate of the coloring material. By this means, movement of the coloring material in the image formed on the recording medium 14 (namely, positional displacement of the dots, color non-uniformities of the dots) is prevented.

Since the image formation drum 44 of the image formation unit 40 is structurally separate from the treatment liquid drum 34 of the treatment liquid application unit 30, then the treatment liquid never splashes the inkjet heads 48M, 48K, 48C and 48Y, and it is possible to reduce the causes of ink ejection abnormalities.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

<Drying Process Unit>

The drying process unit 50 includes the pressure drum (drying drum) 54, which holds and conveys the recording medium 14 after image formation, and a drying process unit 56, which carries out a drying process for evaporating off the water content (liquid component) on the recording medium 14. The basic structure of the drying drum 54 is common with those of the treatment liquid drum 34 and the image formation drum 44 described previously, and therefore further description thereof is omitted here.

The drying process unit 56 is a processing unit which is disposed in a position facing the outer circumferential surface of the drying drum 54 and evaporates off the water content present on the recording medium 14. When the ink is deposited on the recording medium 14 by the image formation unit 40, the liquid component (solvent component) of the ink and the liquid component (solvent component) of the treatment liquid which have been separated by the aggregating reaction between the treatment liquid and the ink remain on the recording medium 14, and therefore it is necessary to remove this liquid component.

The drying process unit 56 carries out a drying process by evaporating off the liquid component present on the recording medium 14, through heating by a heater, or air blowing by a fan, or a combination of these, in order to remove the liquid component on the recording medium 14. The amount of heating and the air flow volume applied to the recording medium 14 are set appropriately in accordance with parameters, such as the amount of water remaining on the recording medium 14, the type of recording medium 14, the conveyance speed of the recording medium 14 (interference processing time), and the like.

When the drying process is carried out by the drying process unit 56, since the drying drum 54 of the drying process unit 50 is structurally separate from the image formation drum 44 of the image formation unit 40, then it is possible to reduce the causes of ink ejection abnormalities due to drying of the head meniscus portions in the inkjet heads 48M, 48K, 48C and 48Y as a result of the applied heat or air flow.

In order to display an effect in correcting cockling of the recording medium 14, the curvature of the drying drum 54 is desirably 0.002 (1/mm) or greater. Furthermore, in order to prevent curving (curling) of the recording medium after the drying process, the curvature of the drying drum 54 is desirably 0.0033 (1/mm) or less.

It is desirable that a device for adjusting the surface temperature of the drying drum 54 (for example, an internal heater) is arranged to adjust the surface temperature to 50° C. or above. Drying is promoted by carrying out a heating process from the rear surface of the recording medium 14, thereby preventing destruction of the image in the subsequent fixing process. According to this mode, more beneficial effects are obtained if a device for fastening the recording medium 14 to the outer circumferential surface of the drying drum 54 is provided. Examples of a device for fastening the recording medium 14 include a vacuum suction device, electrostatic attraction device or the like.

There are no particular restrictions on the upper limit of the surface temperature of the drying drum 54, but from the viewpoint of the safety of maintenance operations such as cleaning the ink adhering to the surface of the drying drum 54 (e.g. preventing burns due to high temperature), desirably, the surface temperature of the drying drum 76 is not higher than 75° C. (and more desirably, not higher than 60° C.).

By holding the recording medium 14 in such a manner that the recording surface thereof is facing outward on the outer circumferential surface of the drying drum 54 having this composition (in other words, in a state where the recording surface of the recording medium 14 is curved in a projection shape), and carrying out a drying process while conveying the recording medium in rotation, it is possible reliably to prevent drying non-uniformities caused by wrinkling or floating up of the recording medium 14.

<Fixing Process Unit>

The fixing process unit 60 includes the pressure drum (fixing drum) 64, which holds and conveys the recording medium 14, a heater 66, which carries out a heating process on the recording medium 14 which the image has been formed on and the liquid has been removed from, and a fixing roller 68, which presses the recording medium 14 from the recording surface side. The basic structure of the fixing drum 64 is common to that of the treatment liquid drum 34, the image formation drum 44 and the drying drum 54, and description thereof is omitted here. The heater 66 and the fixing roller 68 are disposed in positions facing the outer circumferential surface of the fixing drum 64, and are situated in this order from the upstream side in terms of the direction of rotation of the fixing drum 64 (the counter-clockwise direction in FIG. 1).

In the fixing process unit 60, a preliminary heating process by means of the heater 66 is carried out on the recording surface of the recording medium 14, and a fixing process by means of the fixing roller 68 is also carried out. The heating temperature of the heater 66 is set appropriately in accordance with the type of the recording medium, the type of ink (the type of polymer micro-particles contained in the ink), and the like. For example, a possible mode is one where the heating temperature is set to the glass transition temperature or the minimum film forming temperature of the polymer micro-particles contained in the ink.

The fixing roller 68 is a roller member for melting self-dispersing polymer micro-particles contained in the ink and thereby causing a state where the ink is covered by a film (a film is formed), by applying heat and pressure to the dried ink, and is composed so as to apply heat and pressure to the recording medium 14. More specifically, the fixing roller 68 is disposed so as to contact and press against the fixing drum 64, in such a manner that the fixing roller 68 serves as a nip roller with respect to the fixing drum 64. By this means, the recording medium 14 is placed between the fixing roller 68 and the fixing drum 64 and is nipped with a prescribed nip pressure, whereby the fixing process is carried out.

An example of the composition of the fixing roller 68 is a mode where the roller is constituted of a heating roller, which incorporates a halogen lamp inside a metal pipe made of aluminum, or the like, having good heat conductivity. When heat energy to reach the temperature not lower than the glass transition temperature of the polymer micro-particles contained in the ink is applied by heating the recording medium 14 by means of this heating roller, then the polymer micro-particles melt and a transparent film is formed on the surface of the image.

By applying pressure to the recording surface of the recording medium 14 in this state, the polymer micro-particles which have melted are pressed and fixed into the undulations in the recording medium 14, and the undulations in the image surface are thereby leveled out, thus making it possible to obtain a desirable luster. A desirable composition is one where fixing rollers 68 are arranged in a plurality of stages, in accordance with the thickness of the image layer and the glass transition temperature characteristics of the polymer micro-particles.

Furthermore, desirably, the surface hardness of the fixing roller 68 is not higher than 71°. By further softening the surface of the fixing roller 68, it is possible to expect effects in following the undulations of the recording medium 14 which are produced by cockling, and fixing non-uniformities caused by the undulations of the recording medium 14 are prevented more effectively.

The inkjet recording apparatus 10 shown in FIG. 1 includes an in-line sensor 82, which is arranged at a later stage of the processing region of the fixing process unit 60 (on the downstream side in terms of the direction of conveyance of the recording medium). The in-line sensor 82 is a sensor for reading the image formed on the recording medium 14 (or a test pattern (check pattern) formed in the margin area of the recording medium 14), and desirably employs a CCD line sensor.

In the inkjet recording apparatus 10 shown in the present embodiment, the presence and absence of ejection abnormalities in the inkjet heads 48M, 48K, 48C and 48Y are judged on the basis of the reading results of the in-line sensor 82. Furthermore, the in-line sensor 82 may include measurement devices for measuring the water content, surface temperature, luster (gloss level), and the like. According to this mode, parameters, such as the processing temperature of the drying process unit 50 and the heating temperature and applied pressure of the fixing process unit 60, are adjusted appropriately on the basis of the water content, surface temperature and the read result for the luster, and thereby the above control parameters are properly controlled in accordance with the temperature alteration inside the apparatus and the temperature alteration of the respective parts.

<Output Unit>

As shown in FIG. 1, the output unit 70 is arranged subsequently to the fixing process unit 60. The output unit 70 includes an endless conveyance chain 74 wrapped about tensioning rollers 72A and 72B, and an output tray 76, in which the recording medium 14 after image formation is accommodated.

The recording medium 14 which has undergone the fixing process and which is output from the fixing process unit 60 is conveyed by the conveyance chain 74 and output to the output tray 76.

Description of Medium Conveyance Apparatus for Holding and Conveying Recording Medium The medium conveyance apparatus employed in the inkjet recording apparatus 10 shown in FIG. 1 is hereby described in detail. In the description given below, the medium conveyance apparatus employed in the image formation unit 40 (the composition including the image formation drum 44) is given as an example.

<General Composition of Image Formation Drum>

FIG. 2 is a perspective diagram showing the overall structure of the image formation drum 44. As shown in FIG. 2, the image formation drum 44 is a rotating member which is coupled to a rotating mechanism (not illustrated) and is composed so as to be rotatable about a rotational shaft 102 supported by bearings (not illustrated), due to the operation of the rotating mechanism.

The circumferential surface 104 of the image formation drum 44 functions as a medium supporting surface which supports the recording medium 14 (see FIG. 1) from the rear surface side, and has a medium supporting region 106 in which a plurality of suction holes (not depicted individually in FIG. 2, but depicted individually and denoted with reference numeral 150 in FIG. 9) for generating suction pressure (negative pressure) to act on the recording medium 14 are arranged. In the medium supporting region 106 indicated by the dot hatching in FIG. 2, a band-shaped non-open section 108 where no suction holes are formed is arranged through approximately ½ the total perimeter length of the drum, following the circumferential direction, and the rear sides of the restrictor sections (described hereinafter; not shown in FIG. 2 and denoted with reference numeral 134 in FIG. 8) are closed off by this non-open section 108. A medium supporting region having a similar structure is also formed on the rear side which is not depicted in the perspective diagram shown in FIG. 2.

A vacuum flow channel for suction which connects with suction holes arranged in the medium supporting region 106 is arranged inside the image formation drum 44 shown in FIG. 2. This vacuum flow channel is connected to a vacuum pump (described hereinafter; not shown in FIG. 2 and denoted with reference numeral 334 in FIG. 15) arranged externally to the image formation drum 44, through a vacuum tube system (tubes, joints, etc.) which is not shown in FIG. 2 and is arranged in the side face 122 of the image formation drum 44, and vacuum flow channel (not illustrated) arranged inside the rotational shaft 102 of the image formation drum 44. When a vacuum (negative pressure) is generated by operating the vacuum pump, a suction pressure is applied to the recording medium 14 through the suction holes and the vacuum flow channel, and the like. In other words, the image formation drum 44 is composed in such a manner that the recording medium 14 is fastened on the circumferential surface (medium supporting surface) 104 by a vacuum (air) suction method.

Two recess sections 110 are formed throughout the whole length of the outer circumferential surface of the image formation drum 44 in the axial direction thereof, and these two recess sections 110 are arranged at positions approximately 180° apart in the direction of rotation. For the purpose of the drawings, only one recess section 110 of the two recess sections 110 is depicted in FIG. 2. A plurality of grippers 80 which function as gripping devices to grip the leading end portion of the recording medium 14, and a gripper opening and closing mechanism 112 for opening and closing the grippers 80 are disposed in each recess section 110.

Each of the grippers 80 has a hook shape (an approximate L shape, see FIG. 3) and is composed so as to grip the leading end portion of the recording medium 14 by pressing the leading end portion of the recording medium 14 against a hook base 113, which supports the leading end portion of the recording medium 14 from the rear side. The plurality of grippers 80 are disposed equidistantly in the axial direction, and are also disposed through a length corresponding to the maximum width of the recording medium 14. Furthermore, the grippers 80 are accommodated inside the recess section 110 so as not to project beyond the circumferential surface 104 of the image formation drum 44.

The gripper opening and closing mechanism 112 which opens and closes the grippers 80 includes a gripper base (not shown in FIG. 2, denoted with reference numeral 124 in FIG. 3) for supporting the grippers 80, an opening and closing shaft 114 to which the gripper base is coupled, a shaft bracket 116, which supports the opening and closing shaft 114 rotatably with respect to the image formation drum 44, and an opening and closing arm 120, which is coupled to the opening and closing shaft 114 and a cam follower 118. The cam follower 118 and the opening and closing arm 120 are arranged to the outside of the side face 122 of the image formation drum 44.

In the gripper opening and closing mechanism 112 in the present embodiment, the cam follower 118 moves along a prescribed curved cam path in accordance with the operation of a drive source (motor), which is not illustrated, and the opening and closing shaft 114 coupled to the opening and closing arm 120 rotates in such a manner that the grippers 80 perform the opening and closing operation in accordance with the rotation of the opening and closing shaft 114.

After the leading end portion of the recording medium 14 has been gripped by the grippers 80, in order to eliminate distortion produced in the vicinity of the leading end portion of the recording medium 14 due to the whole of the recording medium 14 being pressed by the paper pressing roller 46, the gripper opening and closing mechanism 112 is controlled so as to open and close the grippers 80 in accordance with the position in the direction of rotation of the image formation drum 44. Below, the control of opening and closing of the grippers 80 is described in detail.

<Description of Control of Opening and Closing of Grippers>

FIGS. 3 to 7 are illustrative diagrams illustrating the opening and closing operation of the grippers 80. Descriptions are omitted here about members which are shown in FIGS. 3 to 7 but do not relate directly to the opening and closing of the grippers 80.

Figure 3:
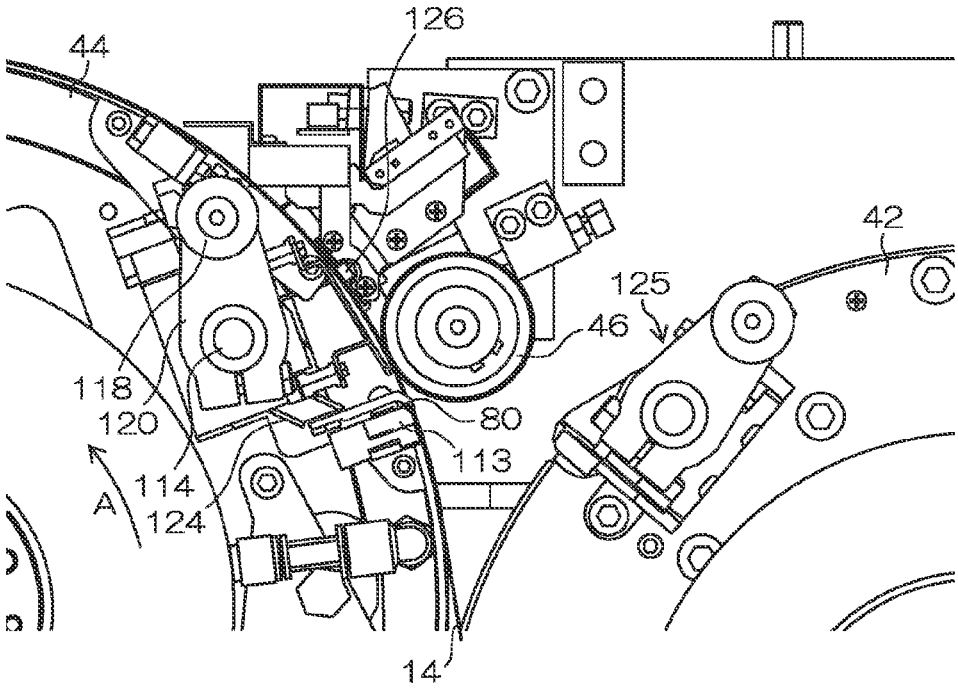
FIG. 3 is a diagram describing the operation of grippers during transfer of paper.

FIG. 3 is a diagram showing a state immediately before the leading end portion of the recording medium 14 arrives at a pressing region of the paper pressing roller 46, when the recording medium 14 is transferred from a paper leading end fixing section 125 of the transfer drum 42 to the grippers 80 of the image formation drum 44. In this state, the leading end portion of the recording medium 14 is gripped (fixed) by the gripper 80 and is conveyed in the direction of the arrow A (the counter-clockwise direction in FIG. 3). As stated previously, the grippers 80 and the hook base 113 are arranged at the positions to the inner side of the circumferential surface of the image formation drum 44, and therefore the leading end portion of the recording medium 14 is held to the inside of the circumferential surface 104 of the image formation drum 44.

In the state shown in FIG. 3, because the portions of the recording medium 14 apart from the leading end portion that is gripped by the grippers 80 are not fastened by suction, then floating up of the vicinity of the leading end portion of the recording medium 14 occurs, but the amount of floating is small. If using a recording medium 14 which is relatively thick, there is a possibility that distortion occurs in the leading end portion or the vicinity thereof, during transfer from the transfer drum 42 to the grippers 80 of the image formation drum 44.

Figure 4:
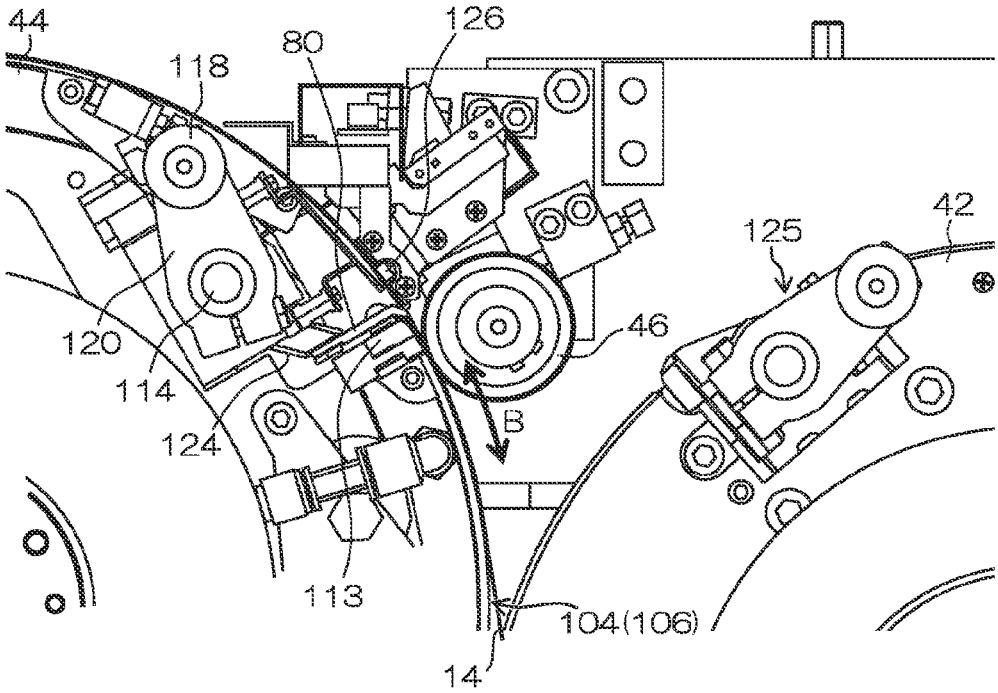
FIG. 4 is a diagram describing the operation of grippers during pressing by a paper pressing roller.

FIG. 4 is a diagram showing a state where the gripper 80 which is gripping the leading end portion of the recording medium 14 is passing through the pressing region by the paper pressing roller 46 and before the gripper 80 arrives at the detection region of the paper floating detection sensor 126. When the leading end portion of the recording medium 14 gripped by the grippers 80 passes through the pressing region of the paper pressing roller 46 and the leading end portion of the recording medium 14 (the portion which is not gripped by the grippers 80) is fastened by suction, the distortion of the vicinity of the leading end portion of the recording medium 14 produces very marked floating since the recording medium 14 lies in tight contact with the image formation drum 44. The region where the recording medium 14 is fastened by suction onto the image formation drum 44 in the state shown in FIG. 4 is represented with a double-headed arrow B.

The thus produced floating up of the recording medium 14 may have the amount of floating of approximately 0.5 mm to 1.0 mm, and if the recording medium 14 enters into the image formation region of the inkjet heads 48M, 48K, 48C and 48Y (see FIG. 1) while retaining this floating, then there is a high possibility of the recording medium 14 making contact with the nozzle faces of the inkjet heads 48M, 48K, 48C and 48Y, and hence it is necessary to restrict the amount of floating of the recording medium 14 to less than the throw distance between the recording medium 14 and the inkjet heads 48M, 48K, 48C and 48Y.

With the image formation drum 44 in the present embodiment, the operation of the grippers 80 is controlled in such a manner that when the recording medium 14 has been fastened by suction on the circumferential surface 104 of the image formation drum 44, the distortion (floating up) of the recording medium 14 is suppressed by temporarily releasing the recording medium 14 from the gripping with the grippers 80 and then gripping the recording medium 14 with the grippers 80 again.

Figure 5:
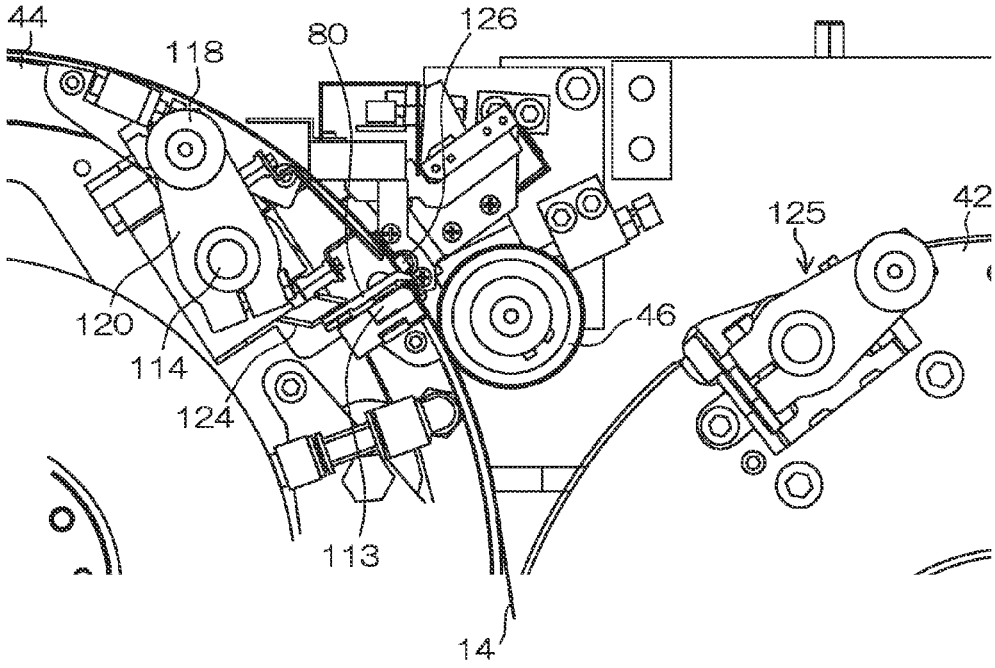
FIG. 5 is a diagram describing the operation of grippers during release of the paper.

FIG. 5 is a diagram showing a state where the gripper 80 has been opened by a prescribed amount in such a manner that a gap exceeding the thickness of the recording medium 14 is created between the gripper 80 and the hook base 113. The image formation drum 44 in the present embodiment operates the gripper opening and closing mechanism 112 (see FIG. 2) in such a manner that the gap exceeding the thickness of the recording medium 14 is created between the gripper 80 and the hook base 113 at the time that the grippers 80 holding the leading end portion of the recording medium 14 pass the pressing region of the paper pressing roller 46. If the grippers 80 are opened by a prescribed amount for a prescribed duration when the portion of the recording medium 14 that is not gripped by the grippers 80 is fastened by suction, the leading end portion of the recording medium 14 that has been gripped by the grippers 80 is released, the distortion that has occurred between the portion that has been gripped by the grippers 80 and the portion that is fastened by suction is eliminated, and floating up of the corresponding portion of the recording medium 14 is reduced.

Figure 6:
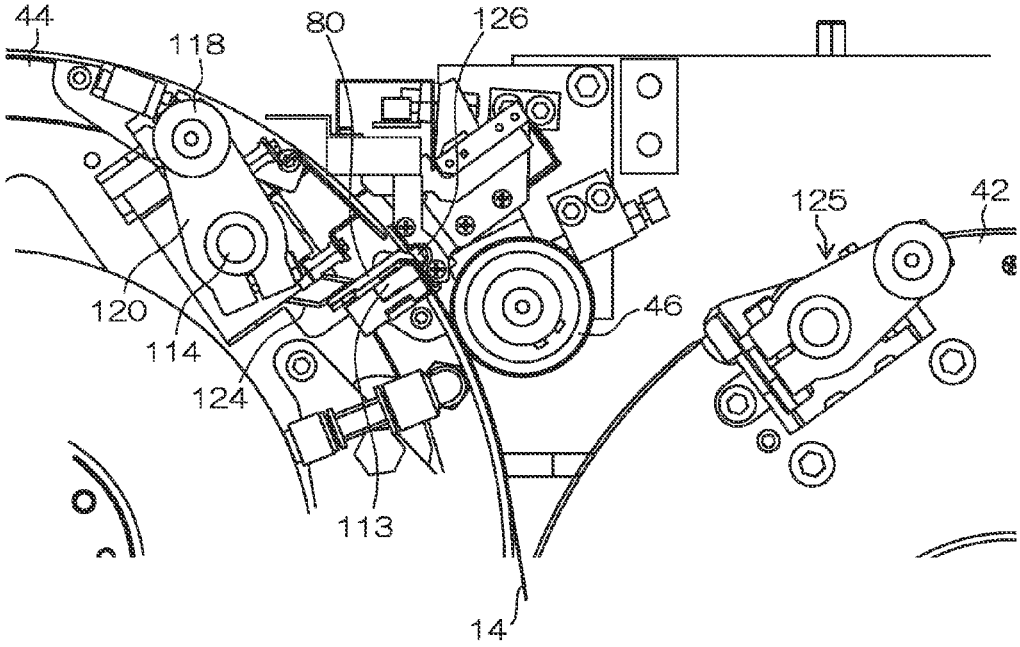
FIG. 6 is a diagram describing the operation of grippers before entering into a detection region of a paper floating detection sensor.

FIG. 6 is a diagram showing a state immediately before the leading end portion of the recording medium 14 (or the gripper 80) arrives at the detection region of the paper floating detection sensor 126. The grippers 80 that have been opened in order to eliminate the distortion of the recording medium 14 start to be closed before arriving at the detection region of the paper floating detection sensor 126. More specifically, the recording medium 14 is set to the same attitude as during image formation, before detection by the paper floating detection sensor 126, thereby making it possible reliably to detect change in the attitude of the recording medium 14 due to the opening and closing of the grippers 80. Furthermore, the amount of opening of the grippers 80 is adjusted in such a manner that the grippers 80 passing through the detection region of the paper floating detection sensor 126 are not observed by the paper floating detection sensor 126, which is thereby prevented from mistakenly detecting the grippers 80 in the open state as floating up of the recording medium 14.

Figure 7:
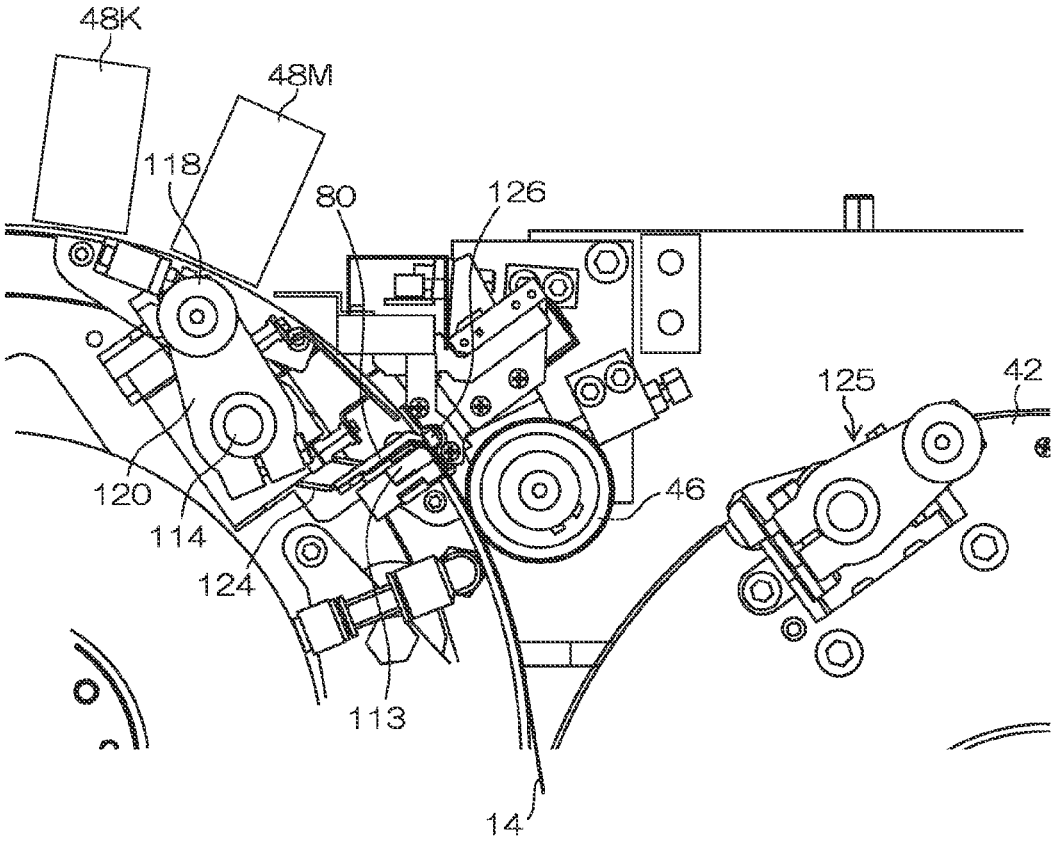
FIG. 7 is a diagram describing the operation of grippers during passage through the detection region of the paper floating detection sensor.

FIG. 7 is a diagram showing a state immediately after the leading end portion of the recording medium 14 (or the gripper 80) has passed the detection region of the paper floating detection sensor 126. The grippers 80 finish closing before leaving the detection region of the paper floating detection sensor 126 and enter into the image formation region of the inkjet head 48M while maintaining the gripping state (the grippers 80 are in a completely closed state) of the leading end portion of the recording medium 14 by the grippers 80.

The position of the recording medium 14 on the conveyance path can be ascertained on the basis of information about the amount of rotation of the image formation drum 44 or a motor that rotates the image formation drum 44, which information is obtained from a determination device, such as an encoder, installed on the rotational shaft of the image formation drum 44 or on the shaft of the motor. Moreover, it is also possible to provide a position determination sensor in the position where the grippers 80 operate on the conveyance path of the recording medium 14, and to ascertain the position of the recording medium 14 by means of this position determination sensor. Signals obtained from the determination device or the position determination sensor described above are supplied to the system control system, which is described below, the position of the recording medium 14 on the conveyance path is ascertained in the system control system, and when the recording medium 14 arrives at the position where the grippers 80 are operated, the grippers 80 are controlled so as to perform the prescribed operation. Furthermore, it is also possible to abut the cam follower 118 against a cam (not illustrate) and operate the grippers 80 at a prescribed timing.

By opening and closing the grippers 80 as described above, distortion produced in the vicinity of the leading end portion of the recording medium 14 (the vicinity of the portion gripped by the grippers 80) is eliminated, floating of the recording medium 14 is reduced, and furthermore erroneous detection in the detection region of the paper floating detection sensor 126 due to the grippers 80 being opened is prevented.

Since the leading end portion of the recording medium 14 is gripped by the grippers 80 before entering into the image formation region of the inkjet heads 48M, 48K, 48C and 48Y, then the recording medium 14 is reliably fastened in such a manner that the floating up of the recording medium 14 during passage through the image formation region of the inkjet heads 48M, 48K, 48C and 48Y is less than the throw distance to the inkjet heads 48M, 48K, 48C and 48Y.

<Description of Vacuum Flow Channels>

Next, the vacuum flow channels employed in the image formation drum 44 shown in the present embodiment is described. The vacuum flow channels described below are no more than examples, and it is also possible to adopt other compositions.

Figure 8:
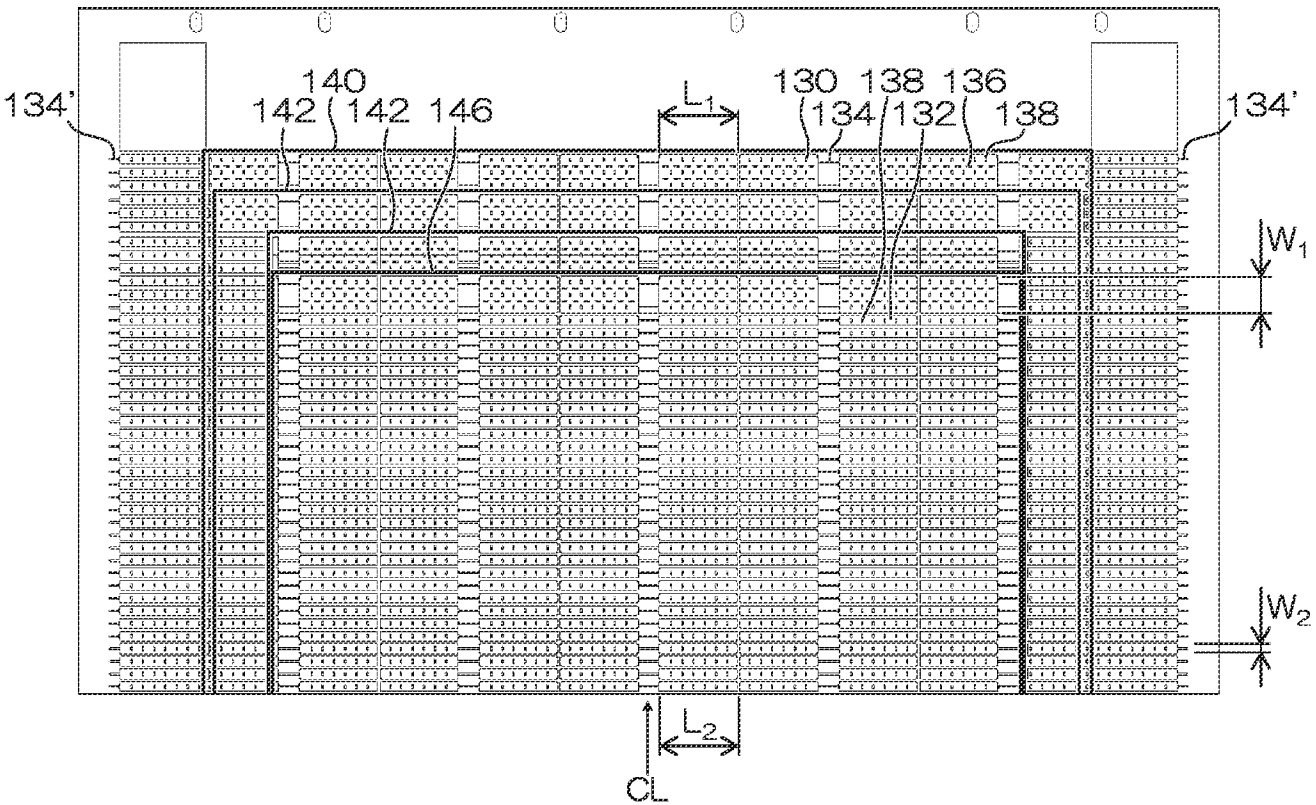
FIG. 8 is a plan diagram showing the internal structure of the medium supporting surface of the conveyance drum in FIG. 2.

FIG. 8 is a projected diagram showing the internal structure of a medium supporting region 106, which is depicted by the dot hatching in FIG. 2 (the structure of the rear side of the suction holes arranged in the medium supporting region 106). The horizontal direction in FIG. 8 is the axial direction and the vertical direction in the circumferential direction; the lower side in FIG. 8 is the leading end side in the direction of conveyance of the recording medium 14, and the position denoted with "CL" is the central position in the axial direction.

As shown in FIG. 8, a plurality of suction grooves 130 and 132 are arranged inside the medium supporting region 106, and the suction grooves 130 and 132 are arranged so as to correspond to four different sizes of recording media, which are depicted by the thick frames denoted with reference numerals 140, 142, 144 and 146.

The width $W_1$ of the suction grooves 130 which are arranged in positions corresponding to the trailing end portion of the recording medium 14 (the upper side in the drawing) is greater than the width $W_2$ of the suction grooves 132 which are arranged in positions corresponding to portions other than the trailing end portion of the recording medium 14 (the center and lower side in the drawing). On the other hand, the length $L_1$ of the suction grooves 130 (the length in the axial direction) and the length $L_2$ of the suction grooves 132 are substantially the same. According to this structure, it is possible to increase the amount of sucked air at the trailing end portion of the recording medium 14 with respect to the central portion and the leading end portion, and hence floating or curling of the trailing end portion of the recording medium 14 is effectively prevented.

As shown in FIG. 8, each of the suction grooves 130 and the suction grooves 132 has a structure in which one end thereof in the axial direction is closed off, while a restrictor section 134 is arranged on the other end. Furthermore, the respective ends of each restrictor section 134 are connected to different suction grooves 130 or suction grooves 132. Of the restrictor sections 134' disposed in the respective end portions in the axial direction, only one (the inner side) is connected to the suction groove 130 or 132, while the other (the outer side) is closed off.

Each of the restrictors 134 has a groove width (cross-sectional area) smaller than the groove widths of the suction grooves 130 and 132, and is disposed on the rear side of the non-open section 108 shown in FIG. 2. Each of the restrictors 134 has a structure in which the rear side (the side of the circumferential surface 104 of the image formation drum 44) is closed off by the non-open section 108. More specifically, the restrictor sections 134 and 134' have a function of restricting the flow rate of air passing through the suction grooves 130 and 132 and prevent the escape of pressure to fasten the recording medium 14 by suction.

Ribs 136 and 138 having a projecting shape are arranged in the suction grooves 130. The ribs 136 and 138 have an island pattern and a height which is roughly equal to the depth of the suction grooves 130 and 132. The ribs 136 are formed in a broken line configuration parallel to the axial direction. Furthermore, a plurality of rows of ribs 136 (rib rows) aligned in a broken line configuration following the axial direction are formed in parallel inside the suction grooves 130 (in FIG. 8, there are two rib rows). The interval between the rib rows is approximately equal to the width of the suction grooves 132. Moreover, the ribs 138 formed in a broken line shape along the circumferential direction are arranged in the gaps between the ribs 136 which are aligned in parallel in the axial direction.

By arranging the island-shaped ribs 136 and 138 which are respectively divided up in this way, it is possible to prevent the recording medium 14 fasten by suction on the medium supporting region 106 from becoming indented from a circular arc shape, and therefore a uniform throw distance can be maintained. Furthermore, since air is able to move through the gaps between the divided ribs 136 and 138, it is possible to ensure the flow volume of air in the suction grooves 130.

Furthermore, the ribs 138 formed along the circumferential direction in the suction grooves 132 are arranged in the axial direction. Gaps are formed between the walls of the suction grooves 132 and the ribs 138, in such a manner that air can move through these gaps.

Figure 9:
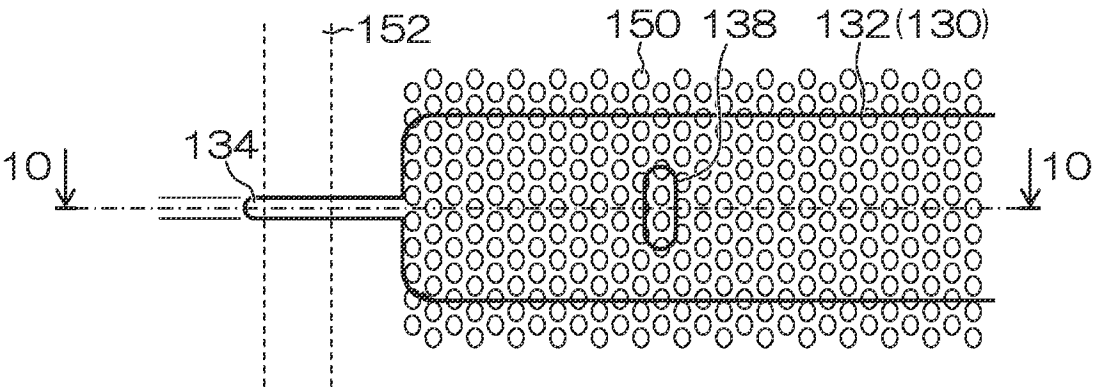
FIG. 9 is a partial enlarged diagram of the medium supporting surface in FIG. 8.

FIG. 9 is a partial enlarged diagram of the medium supporting region 106. As shown in FIG. 9, the suction holes 150 are arranged in the medium supporting region 106. The arrangement relationship between the suction holes 150 and the suction grooves 132 (130) is as shown in FIG. 9. The arrangement pattern of the suction holes 150 desirably corresponds to the pattern of the suction grooves 132 (130) on the rear surface, but some of the suction holes 150 can be disconnected from the suction groove 132 (130).

The width of the restrictor sections 134 is narrower than the width of the suction grooves 132, whereas the restrictor sections 134 and the suction grooves 132 (130) have substantially the same depth. More specifically, the flow channel cross-sectional area of the restrictor sections 134 is smaller than the flow channel cross-sectional area of the suction grooves 132, and the flow volume of air flowing in the suction grooves 132 (130) is limited by the restrictor sections 134.

A drum suction groove 152 represented with the broken lines in FIG. 9 connects with the restrictor sections 134 (134') and connects with the vacuum flow channel arranged inside the image formation drum 44 through the drum suction hole (not illustrated). Furthermore, similarly to the restrictor sections 134 and 134', the circumferential surface (104) side of the drum suction groove 152 is closed off by the non-open section 108 (see FIG. 2).

Figure 10:
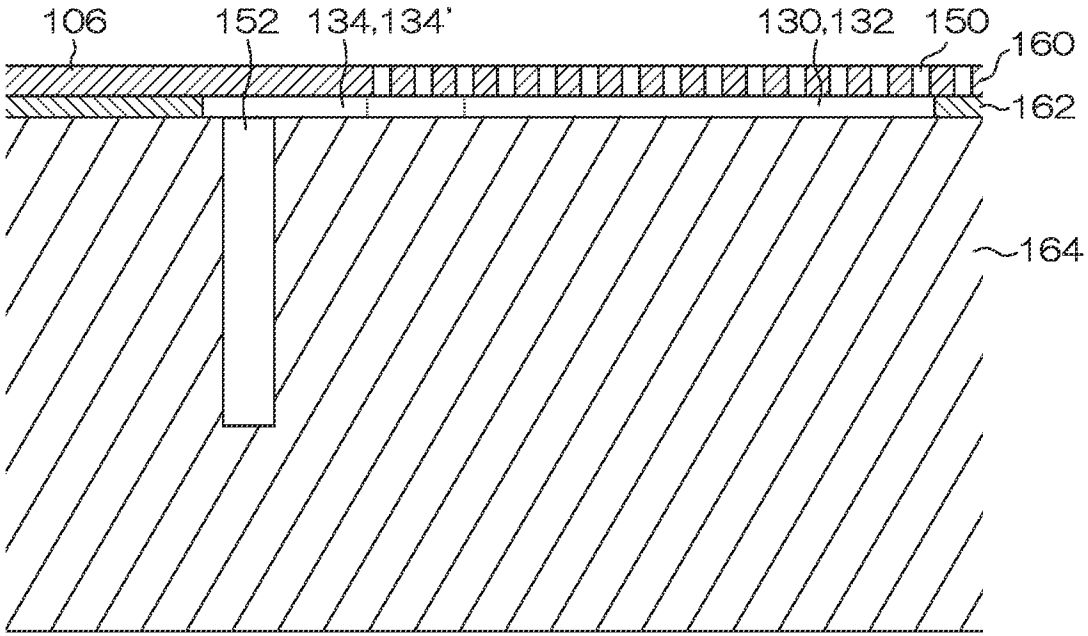
FIG. 10 is a cross-sectional diagram along line 10-10 in FIG. 9.

FIG. 10 is a cross-sectional diagram along line 10-10 in FIG. 9, and shows the inner structure of the image formation drum 44. As shown in FIG. 10, the image formation drum 44 can be considered as being divided into a suction layer 160 in which the suction holes 150 are arranged, an intermediate layer 162 in which the suction grooves 130 and 132 and the restrictor sections 134 and 134' are arranged, and a main body section 164 in which the drum suction groove 152 is arranged.

For example, a structure can be adopted in which each of the suction layer 160 and the intermediate layer 162 is constituted of one sheet-shaped member, the intermediate layer 162 is wrapped over the main body section 164 in which a prescribed flow channel structure and rotation mechanism, and the like, are arranged, and the suction layer 160 is wrapped over the intermediate layer 162. Furthermore, it is also possible to form the suction layer 160 and the intermediate layer 162 as a single body and to wrap a single sheet-shaped member in which the suction holes 150, the suction grooves 130 and 132 and the restrictor sections 134 and 134' are formed, over the main body section 164.

The thickness of the suction layer 160 is desirably greater than the thickness of the intermediate layer 162. In the mode shown in FIG. 10, the thickness of the intermediate layer 162 with respect to the thickness of the suction layer 160 is approximately ½. The intermediate layer 162 is a prescribed thickness portion on the rear surface side of the sheet in which a pattern of the suction grooves 130 and 132 and the ribs 136 and 138, and the like, described in FIG. 8 is formed. The smaller the thickness of the intermediate layer 162, the more possible it becomes to obtain a high suction force by means of a small negative pressure, but if the layer is excessively thin, then blockages caused by paper dust, dirt and other foreign matter become liable to occur. Taking conditions such as these into consideration, it is desirable that the thickness of the intermediate layer 162 is approximately 0.05 mm to 0.5 mm.

The suction layer 160 is required to have a thickness that ensures sufficient rigidity to avoid depression due to the suction pressure in the portions where the ribs 136 and 138 are not present therebelow, and in order to wrap and hold the suction layer 160 about the main body section 164, a certain flexibility is required. For instance, desirably, the thickness of the suction layer 160 fabricated from stainless steel is approximately 0.1 mm to 0.5 mm, more desirably approximately 0.2 mm to 0.3 mm. When materials other than stainless steel are used, the thickness is designed to an appropriate thickness in consideration of the rigidity and flexibility of materials to be used.

The planar shape of the suction holes 150 may be a shape other than a circular shape, such as an elliptical or polygonal shape, or the like. Furthermore, it is also possible to possible to adopt a structure which omits the suction holes 150. However, whatever the structure used, the structure is required in which the rear side (circumferential surface 104 side) of the restrictors 134 and 134' is necessarily closed off, and the restrictors sections 134 and 134' are not directly open to the air.

With the vacuum flow channels described above, even if there are the suction holes 150 and the suction grooves 130 and 132 which are open (to the air) when using a recording medium having a size smaller than a recording medium of maximum size, suction pressure does not escape through the open suction holes 150 and suction grooves 130 and 132, due the action of the restrictor sections 134 and 134', and it is possible to maintain a prescribed suction force with respect to recording media 14 of various sizes.

<Structure of Inkjet Head>

Figure 11:
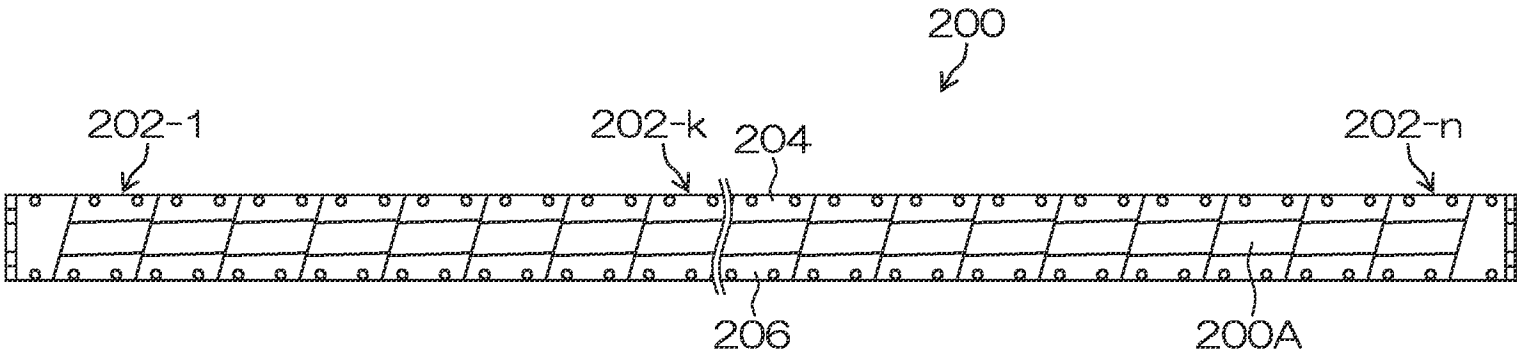
FIG. 11 is a plan view perspective diagram showing the composition of an inkjet head.

Next, one example of the structure of the inkjet heads 48M, 48K, 48C and 48Y arranged in the image formation unit 40 is described. FIG. 11 is a general schematic drawing of an inkjet head 200; FIG. 11 shows a view of a recording surface of a recording medium as viewed from the inkjet head 200 (i.e., a plan view perspective diagram of the head). The inkjet heads 48M, 48K, 48C and 48Y corresponding to the respective colors have a common structure, and therefore these inkjet heads are represented by the inkjet head 200 (hereinafter referred to simply as "head") below.

The head 200 shown in FIG. 11 forms a multiple head by joining together n sub-heads 202-*k* (where k is an integer from 1 to n) in a row. The sub-heads 202-*k* are supported by head covers 204 and 206 from either side of the widthwise direction of the head 200. It is also possible to constitute a multi-head by arranging sub-heads 202 in a staggered configuration.

One example of the application of the multi-head constituted of the sub-heads is a full-line head which corresponds to the entire width of a recording medium. The full line head has a structure in which a plurality of nozzles (denoted with reference numeral 208 in FIG. 13) are arranged through the dimension (width) of the recording medium in the main scanning direction, following the direction (main scanning direction) which is perpendicular to the direction of movement of the recording medium (sub-scanning direction). An image can be formed over the full surface of the recording medium by means of a so-called single-pass image recording method in which image recording is carried out by performing just one relative scanning action by the head 200 having this structure with respect to a recording medium.

Figure 12:
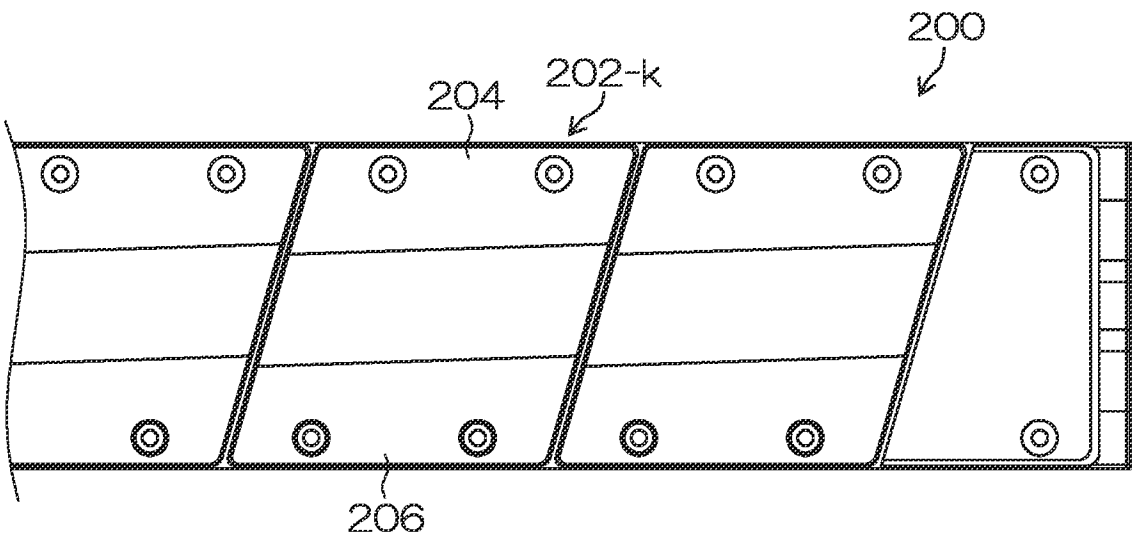
FIG. 12 is a partial enlarged diagram of the inkjet head in FIG. 11.

FIG. 12 is a partial enlarged diagram of the head 200. As shown in FIG. 12, each of the sub-heads 202 has a substantially parallelogram-shaped planar shape, and an overlap section is provided between mutually adjacent sub-heads. The overlap section is a joint section between the sub-heads, in which dots that are mutually adjacent in the alignment direction of the sub-heads 202-*k* (the horizontal direction in FIG. 12; the main scanning direction X in FIG. 13) are formed by the nozzles belonging to different sub-heads.

Figure 13:
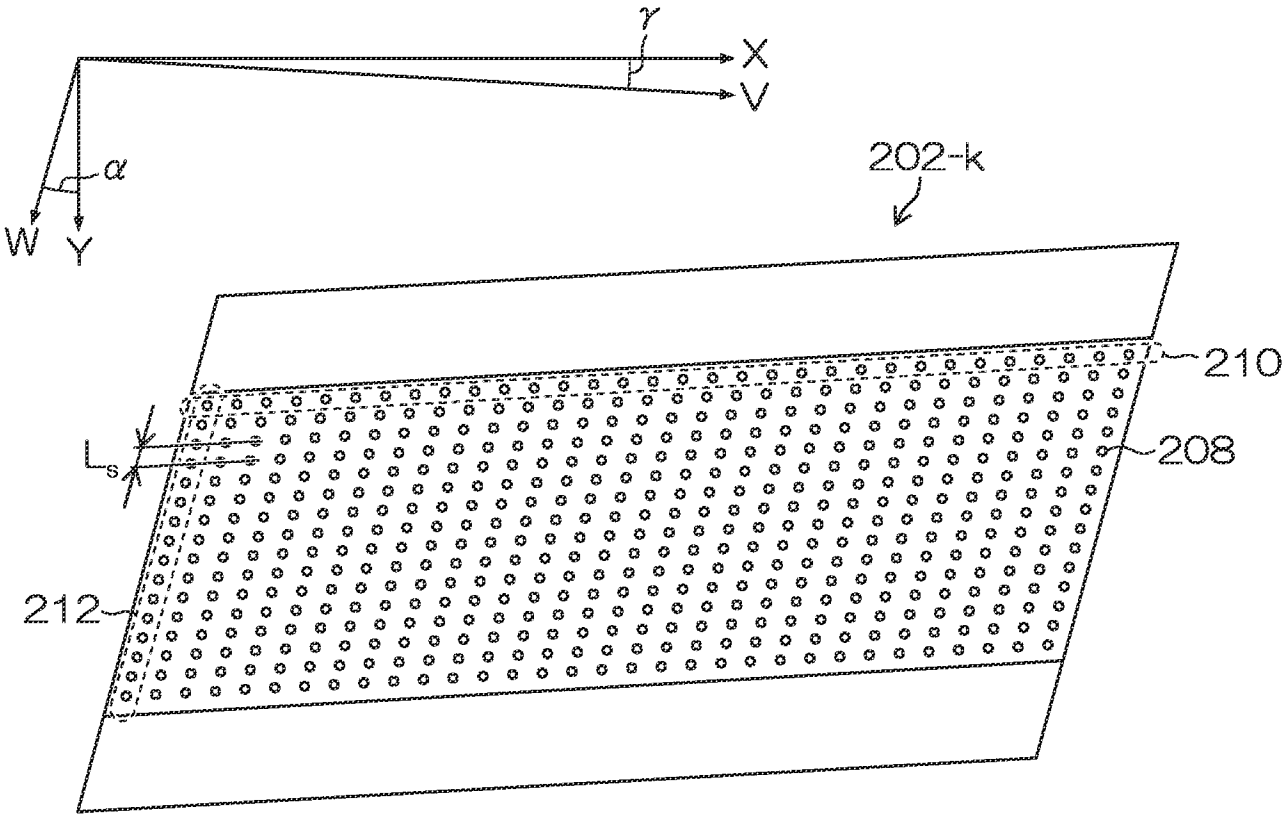
FIG. 13 is a plan diagram illustrating a nozzle arrangement in the inkjet head shown in FIG. 11.

FIG. 13 is a plan diagram showing a nozzle arrangement in the sub-head 202-*k*. As shown in FIG. 13, each sub-head 202-*k* has a structure in which the nozzles 208 are arranged two-dimensionally, and the head which includes sub-heads 202-*k* of this kind is known as a so-called matrix head. The sub-head 202-*k* shown in FIG. 13 has a structure in which the nozzles 208 are arranged in a column direction W that forms an angle $\alpha$ with respect to the sub-scanning direction Y, and a row direction V that forms an angle $\beta$ with respect to the main scanning direction, thereby achieving a high density of the effective nozzle arrangement in the main scanning direction X. In FIG. 13, a nozzle group (nozzle row) arranged in the row direction V is denoted with reference numeral 210, and a nozzle group (nozzle column) arranged in the column direction W is denoted with reference numeral 212.

Figure 14:
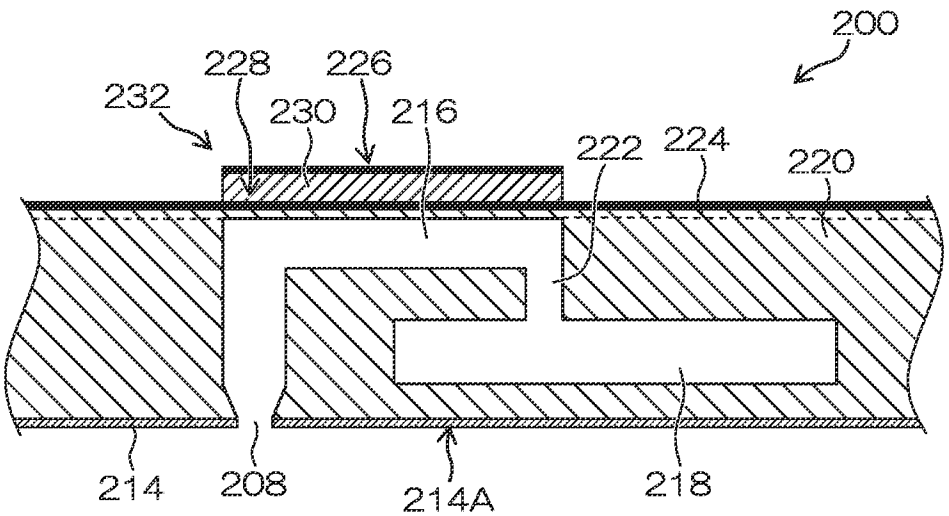
FIG. 14 is a cross-sectional diagram showing the internal structure of the inkjet head in FIG. 11.

FIG. 14 is a cross-sectional diagram showing the inner composition of a droplet ejection element of one channel which is the unit of the recording elements (namely, an ink chamber unit corresponding to one nozzle 208). As shown in FIG. 14, the head 200 according to the present embodiment has a structure in which a nozzle plate 214 in which the nozzles 208 are formed, and a flow channel plate 220, and the like, in which flow channels such as pressure chambers 216 and a common flow channel 218, and the like, are formed are layered and bonded together. The nozzle plate 214 constitutes the nozzle face 214A of the head 200, and the nozzles 208 which are connected respectively to the pressure chambers 216 are arranged in a two-dimensional configuration therein.

The flow channel plate 220 is a flow channel forming member which constitutes side wall portions of the pressure chambers 216 and in which a supply port 222 is formed to serve as a restricting section (most constricted portion) of an individual supply channel for guiding ink to each pressure chamber 216 from the common flow channel 218. For the sake of the description, a simplified view is given in FIG. 14, but the flow channel plate 220 may have a structure formed by layering together one or a plurality of substrates.

The nozzle plate 214 and the flow channel plate 220 can be processed into a desired shape by a semiconductor manufacturing process using silicon as a material.

The common flow channel 218 is connected to an ink tank (not shown), which is a base tank that supplies the ink, and the ink supplied from the ink tank is supplied through the common flow channel 218 to the pressure chambers 216.

On a diaphragm 224 which constitutes a portion of the face of the pressure chamber 216 (the ceiling face in FIG. 14), a piezoelectric actuator 232 constituted of an individual electrode 226, a lower electrode 228, and a piezoelectric body 230 placed between the individual electrode 226 and the lower electrode 228 is bonded. If the diaphragm 224 is constituted of a metal thin film or a metal oxide film, then the diaphragm 40 also functions as a common electrode which corresponds to the lower electrode 228 of the piezoelectric actuator 232. In a mode in which the diaphragm is made from a non-conductive material, such as resin, a lower electrode layer made of a conductive material, such as metal, is formed on the surface of the diaphragm member.

When a drive voltage is applied to the individual electrode 226, the piezoelectric actuator 232 deforms, thereby changing the volume of the pressure chamber 216. This causes a pressure change which results in the ink being ejected from the nozzle 208. When the piezoelectric actuator 232 returns to its original position after ejecting the ink, the pressure chamber 216 is replenished with new ink from the common flow channel 218 through the supply port 222.

A high-density nozzle head according to the present embodiment is achieved by arranging a plurality of ink chamber units having a structure of this kind in a lattice configuration according to a prescribed arrangement pattern in the row direction V that forms the angle $\beta$ with respect to the main scanning direction X and the column direction W that forms the angle $\alpha$ with respect to the sub-scanning direction Y, as shown in FIG. 12. If the pitch between adjacent nozzles in the sub-scanning direction is taken to be Ls, then this matrix arrangement can be treated as equivalent to a configuration where the nozzles 208 are effectively arranged in a single straight line at a uniform pitch of $P=Ls/\tan\theta$ apart in the main scanning direction.

In the present embodiment, the piezoelectric actuator 232 is used as the ink ejection force generating device, which causes the ink to be ejected from the nozzle 208 in the head 200; however, it is also possible to employ a thermal method in which a heater is arranged inside the pressure chamber 216 and the ink is ejected by using the pressure of the film boiling action caused by the heating action of this heater.

<Description of Control System>

Figure 15:
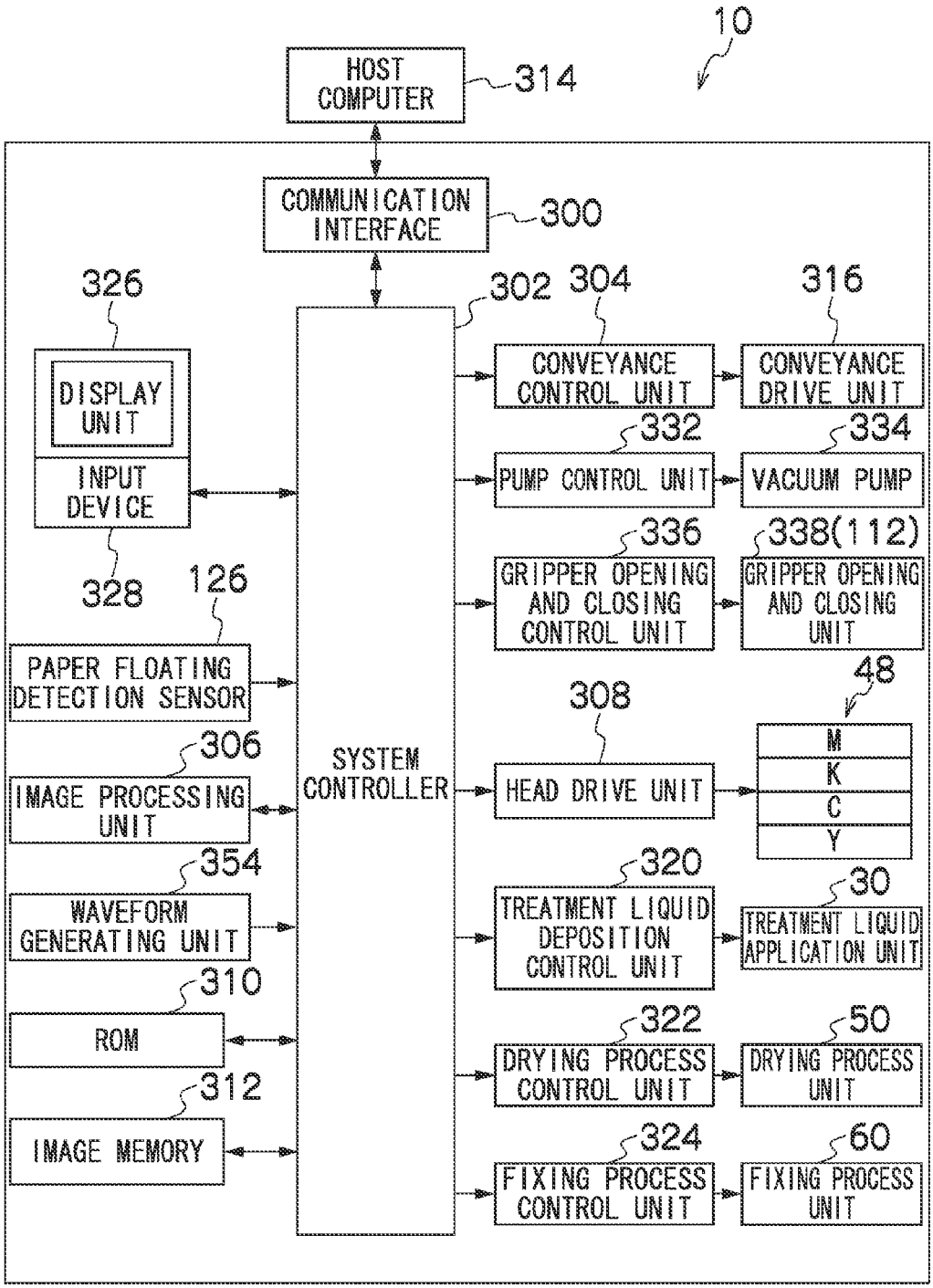
FIG. 15 is a block diagram showing the system configuration of the inkjet recording apparatus in FIG. 1.

FIG. 15 is a block diagram showing the composition of the control system of the inkjet recording apparatus 10. The inkjet recording apparatus 10 includes a communication interface 300, a system controller 302, a conveyance control unit 304, an image processing unit 306, and a head driving unit 308, a ROM 310 and an image memory 312.

The communication interface 300 is an interface unit for receiving image data which is transmitted by a host computer 314. The communication interface 300 may employ a serial interface, such as a USB (Universal Serial Bus), or a parallel interface, such as a Centronics device. It is also possible to install a buffer memory (not illustrated) in the communication interface 300 for achieving high-speed communications.

The system controller 302 is constituted of a central processing unit (CPU) and peripheral circuits of same, and the like, and functions as a control unit which controls the whole of the inkjet recording apparatus 10 in accordance with a prescribed program, as well as functioning as a calculating unit which performs various calculations and also functioning as a memory controller for the ROM 310 and the image memory 312. In other words, the system controller 302 controls the various sections, such as the communication interface 300, the conveyance control unit 304, and the like, as well as controlling communications with the host computer 314 and read and writing to and from the ROM 310 and the image memory 312, and the like, and generating control signals which control the respective units described above.

The image data sent from the host computer 314 is input to the inkjet recording apparatus 10 through the communication interface 300, and prescribed image processing is carried out by the image processing unit 306.

The image processing unit 306 is a control unit which has signal (image) processing functions for carrying out various treatments, corrections and other processing in order to generate a signal for controlling printing from the image data, and which supplies the generated print data to the head drive unit 308. Required signal processing is carried out in the image processing unit 306 and the ejected droplet volume (droplet ejection volume) and the ejection timing of the head 48 are controlled via the head drive unit 308 on the basis of the image data. By this means, a desired dot size and dot arrangement are achieved. The head drive unit 308 shown in FIG. 15 may also include a feedback control system for maintaining uniform drive conditions in the head 48.

The conveyance control unit 304 controls the conveyance timing and conveyance speed of the recording medium 14 (see FIG. 1) on the basis of the print control signal generated by the image processing unit 306. The conveyance drive unit 316 in FIG. 15 includes motors which rotate the pressure drums 34, 44, 54 and 64 and the transfer drums 32, 42, 52 and 62 in FIG. 1, a motor of the conveyance mechanism of the recording medium 14 in the paper supply unit 20, a motor which drives the tensioning roller 72A (72B) of the output unit 70, and the like, and the conveyance control unit 304 functions as a driver of the motors described above.

The conveyance control unit 304 controls the operation of the paper pressing roller 46 (see FIG. 1) arranged in the image formation unit 40. For example, when the system control unit 302 obtains recording medium information, such as the thickness of the recording medium 14, the type of recording medium 14, and the like, the pressing force of the paper pressing roller 46 (the distance with respect to the circumferential surface 104 of the image formation unit 44) is altered suitably.

The paper floating detection sensor 126 is the sensor for determining the amount of floating of the recording medium 14 which is fastened on the image formation unit 44. A mode using an optical sensor is given as an example of the composition of the paper floating detection sensor 126. For example, it is possible to employ a mode in which a light transmitter and a light receptor are disposed on either side of the image formation unit 44, and to emit inspection light from the light transmitter (inspection light source) toward the light receptor (photo sensor). Instead of the optical sensor, it is also possible to employ an ultrasonic sensor, a reflective photo-interrupter, a transmissive photo-interrupter system fitted with a lever (actuator), or the like, and it is also possible to employ a composition in which a wire is stretched in the axial direction of the image formation unit 44 and the amount of tension in the wire due to contact with the recording medium 14 is measured.

Upon receiving information about the amount of investigation light received by the light receptor, the system controller 302 judges whether or not the amount of floating up of the recording medium exceeds a prescribed amount by comparing the amount of received light with a prescribed threshold value. If it is judged that the amount of floating of the recording medium 14 fastened on the image formation unit 44 is greater than the prescribed amount, then a command signal is sent from the system control unit 302 to the conveyance control unit 304 in such a manner that the conveyance of the recording medium 14 is halted before the recording medium 14 enters into the image formation region of the head 48. Furthermore, the system control unit 302 displays a notification to this effect on a display unit 328.

A desirable mode is one where threshold values corresponding to the thickness and type of recording media 14 are determined and stored in advance, and the threshold value is switched in accordance with information about the recording medium 14.

The ROM 310 stores programs which are executed by the CPU of the system controller 302, and various data and control parameters, and the like, which are necessary for controlling the respective sections of the apparatus, and reading and writing of data are performed through the system controller 302. The ROM 310 is not limited to a memory constituted of semiconductor devices, and may also employ a magnetic medium, such as a hard disk. Furthermore, the storage unit may also include an external interface to use a detachable storage medium.

The image memory (primary storage memory) 312 has the functions of a primary storage device for temporarily storing image data input through the communication interface 300, and the functions of a development area for various programs stored in the ROM 310 and a calculation work area for the CPU (for example, a work area for the image processing unit 306). A volatile memory (RAM) which can be read from and written to sequentially is used as the image memory 312.

The inkjet recording apparatus 10 further includes a treatment liquid application control unit 320, a drying process control unit 322 and a fixing process control unit 324, which respectively controls the operation of the respective sections of the treatment liquid application unit 30 including the treatment liquid application unit 36 (see FIG. 1), the drying process unit 50 including the drying process unit 56 (see FIG. 1), and the fixing process unit 60 including the heater 66 and the fixing roller 68 (see FIG. 1) in accordance with instructions from the system controller 124.

The treatment liquid application control unit 320 controls the timing of treatment liquid application, as well as controlling the amount of treatment liquid applied, on the basis of print data obtained from the image processing unit 306. The drying process control unit 322 controls the timing of the drying process in the drying process unit 56, as well as controlling the process temperature, air flow volume, and the like.

The fixing process control unit 324 controls the temperature of the heater 66 as well as the application pressure of the fixing roller 68.

The in-line determination unit (not shown) including the in-line sensor 82 as shown in FIG. 1 is a processing block that includes a signal processing unit for carrying out prescribed signal processing, such as noise reduction, amplification, waveform shaping, and the like, of the read signal output from the in-line sensor 82. The system controller 302 judges the presence or absence of ejection abnormalities in the head 48 on the basis of the determination signal obtained by the in-line determination unit.

The pump control unit 332 controls the vacuum pump 334 which generates suction pressure for fastening the recording medium 14 (see FIG. 1) on the pressure drums 34, 44 (image formation drum 44 in FIG. 2), 54 and 64. For example, when the recording medium 14 which has undergone prescribed processing is supplied to the image formation drum 44, the vacuum pump 334 connected to the vacuum flow channel of the image formation drum 44 is operated and a vacuum (negative pressure) is generated in accordance with the type and size and the bending rigidity of the recording medium 14, and the opening and closing control of the grippers 80 (See FIG. 1).

More specifically, when the system controller 302 acquires control information about the vacuum pump 334 such as information about the type of recording medium 14 and information about the opening and closing control of the grippers 80, the control information is sent to the pump control unit 332. The pump control unit 332 sets the suction pressure in accordance with the control information, and controls the on/off switching and the generated pressure of the vacuum pump 334 in accordance with this setting.

For example, if using a recording medium having low bending rigidity, such as thin paper, the suction pressure is set lower than standard, and if using a recording medium having high bending rigidity, such as thick paper, the suction pressure is set higher than standard. Furthermore, depending on the thickness of the recording medium, if a thick recording medium is used, then the suction pressure is set higher than standard and if a thin recording medium is used, then the suction pressure is set lower than standard. A data table is desirably created by associating the type of recording media (e.g. thickness and bending rigidity) with the suction pressure, and this table is desirably stored in a prescribed memory (for example, the ROM 310 in FIG. 15).

FIG. 15 shows only one vacuum pump 334, but it is also possible to provide a vacuum pump 334 with respect to each of the pressure drums 34, 44, 54 and 64, or to provide a switching device, such as a control valve, at an intermediate point of the vacuum flow channel and perform selective switching using one vacuum pump so as to correspond to the plurality of pressure drums. Furthermore, in each of the pressure drums 34, 44, 54 and 64, the medium fastening region may be divided into a plurality of sections, and a vacuum pump 334 may be connected to each section.

A gripper opening and closing control unit 336 controls a gripper opening and closing mechanism 338 (the gripper opening and closing mechanism 112 shown in FIG. 2, and the like) which operates (opens and closes) the grippers 80 arranged in each of the pressure drums 34, 44, 54 and 64, in accordance with the transfer of the recording medium 14. For example, the grippers of the transfer drum 42 and the grippers 80 of the image formation drum 44 are arranged at separate positions in the widthwise direction of the recording medium 14, and have a structure in which the grippers 80 of the image formation unit 44 enter in between the grippers of the transfer drum 42 in a state where the grippers of the transfer drum 42 are gripping the recording medium 14, thereby achieving a composition whereby the recording medium 14 can be gripped simultaneously by both the grippers of the transfer drum 42 and the grippers 80 of the image formation unit 44.

When the recording medium 14 is transferred from the transfer drum 42 to the image formation unit 44, the leading end portion of the recording medium 14 gripped by the grippers of the transfer drum 42 is gripped by the grippers 80 of the image formation unit 44, and when the grippers of the transfer drum are subsequently opened, the recording medium 14 is gripped only by the grippers 80 of the image formation unit 44 and is transferred from the transfer drum 42 to the image formation unit 44. A similar system is employed for transferring the recording medium 14 between the other transfer drums 32, 52 and 62 and the pressure drums 34, 54 and 64. Furthermore, the operation of the gripper opening and closing mechanism 112 arranged in the image formation unit 44 is controlled as described with reference to FIGS. 3 to 7, by the gripper opening and closing control unit 336.

The inkjet recording apparatus 10 described in the present embodiment includes, as a user interface, an input device 326 for the operator (user) to make various inputs and the display unit (display monitor) 328. The input device 326 may employ various modes, such as a keyboard, mouse, touch panel, buttons, or the like. By operating the input apparatus 326, an operator can perform actions such as inputting print conditions, selection the image quality mode, inputting and editing additional information, searching for information, and the like, and can confirm various information such as input content, search results, and the like, through the display on the display unit 328. The display unit 328 also functions as a device which displays warnings, such as error messages.

According to the inkjet recording apparatus 10 (medium conveyance apparatus) having the composition described above, the recording medium 14 gripped by the grippers 80 of the image formation unit 44 is temporarily released by the grippers 80 after being pressed by the paper pressing roller 46, whereupon the leading end portion is gripped again by the grippers 80 when a prescribed period of time has elapsed. Therefore, distortion in the recording medium 14 which occurs during transfer is released and the recording medium 14 can be fastened to the image formation unit 44 in a state of reduced floating.

Since the distortion in the recording medium 14 is eliminated and floating up of the recording medium 14 is reduced by opening the grippers 80 after the region apart from the leading end portion of the recording medium 14 has been fastened by suction, then positional displacement of the recording medium 14 upon opening the grippers 80 is prevented. Moreover, since the recording medium 14 is fastened by suction on the circumferential surface 104 of the image formation unit 44 after the paper pressing roller 46 has been pressed against the recording medium 14, then the recording medium 14 is positioned with good accuracy on the circumferential surface 104 of the image formation unit 44.

Since the grippers 80 start to close before the leading end of the recording medium 14 enters into the detection region of the paper floating detection sensor 126, and since the grippers 80 finish closing before the leading end of the recording medium 14 exits from the detection region of the paper floating detection sensor 126, then change in the state of the recording medium 14 due to the opening and closing of the grippers 80 is detected reliably if any.

Since the grippers 80 are disposed on the inside of the image formation drum 44 so as not to project from the circumferential surface 104 of the image formation unit 44, then it is possible to reduce the throw distance between the inkjet heads 48 and the recording medium 14, and to place the inkjet heads 48 and the recording medium 14 in close proximity, thus further raising the printing position accuracy.

In the embodiment described above, the pressure drum (rotation) conveyance method is described as the example, but the present invention may also be applied to another conveyance method, such as a belt conveyance method. Furthermore, paper, resin sheet, metal sheet, and various other sheet-shaped media, can be given as examples of the medium which can be used in the medium conveyance apparatus described in the present embodiment.

Modified Embodiments

Next, first to third modifications of the embodiment according to the present invention described above are explained. In the following description, elements which are the same as or similar to the composition described previously are denoted with the same reference numerals and further explanation thereof is omitted here.

<First Modification>

Figure 16:
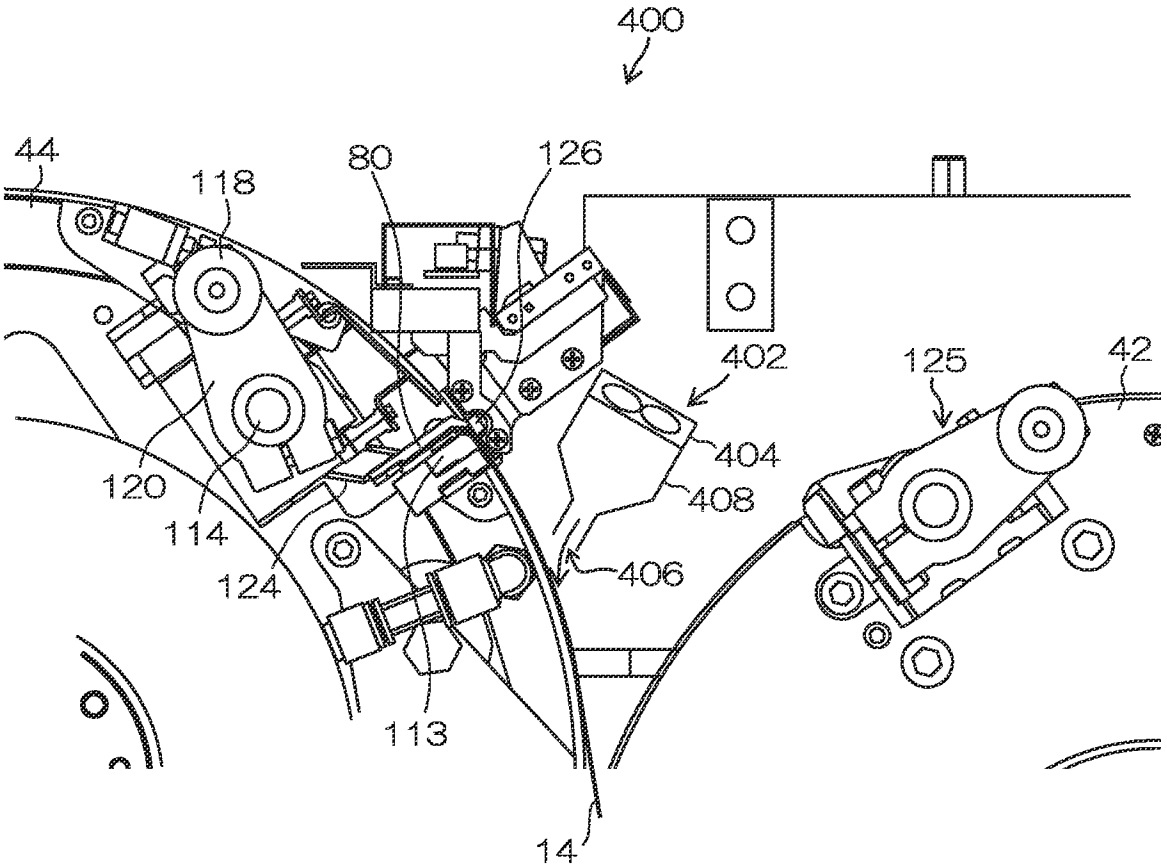
FIG. 16 is a diagram showing the composition of a first modification of the medium conveyance apparatus shown in FIG. 5.

FIG. 16 is a diagram showing the composition of a medium conveyance apparatus according a first modification of the embodiment. The medium conveyance apparatus 400 shown in FIG. 16 includes a non-contact-type paper pressing unit 402 instead of the paper pressing roller 46 shown in FIG. 2, in such a manner that the recording medium 14 is pressed against the circumferential surface 104 of the image formation unit 44 by blowing an air flow onto the image forming surface of the recording medium 14 from the paper pressing unit 402.

More specifically, the paper pressing unit 402 shown in FIG. 16 includes an air blowing fan 404, which generates a flow of air that is blown onto the recording medium 14, and a frame 408, which supports the air blowing fan 404 and in which an opening 406 is arranged in a face opposing the circumferential surface 104 of the image formation unit 44.

The paper pressing unit 402 may have an opening 406 of a length corresponding to the full width of the recording medium 14, or the length of the opening 406 may be shorter than the full width of the recording medium 14, or the opening 406 may be moved using a prescribed movement mechanism throughout the full width of the recording medium 14. Furthermore, if the air blowing fan 404 is composed in such a manner that the air flow volume can be varied in accordance with the thickness, size and type of the recording media 14, then it is possible to blow a desirable air flow onto the fastened recording medium 14 in accordance with the recording media 14 of various thicknesses, sizes and types.

According to the medium conveyance apparatus 400 having this composition, it is possible to cause the recording medium 14 to make tight contact with the circumferential surface 104 of the image formation unit 44, by the non-contact method, and therefore the treatment liquid or ink which has not yet dried does not adhere to the paper pressing unit 402 and it is possible to prevent soiling of the image forming surface of the recording medium 14 due to the treatment liquid or ink which has adhered to the paper pressing unit 402 being transferred back to the recording medium 14.

<Second Modification>

Figure 17:
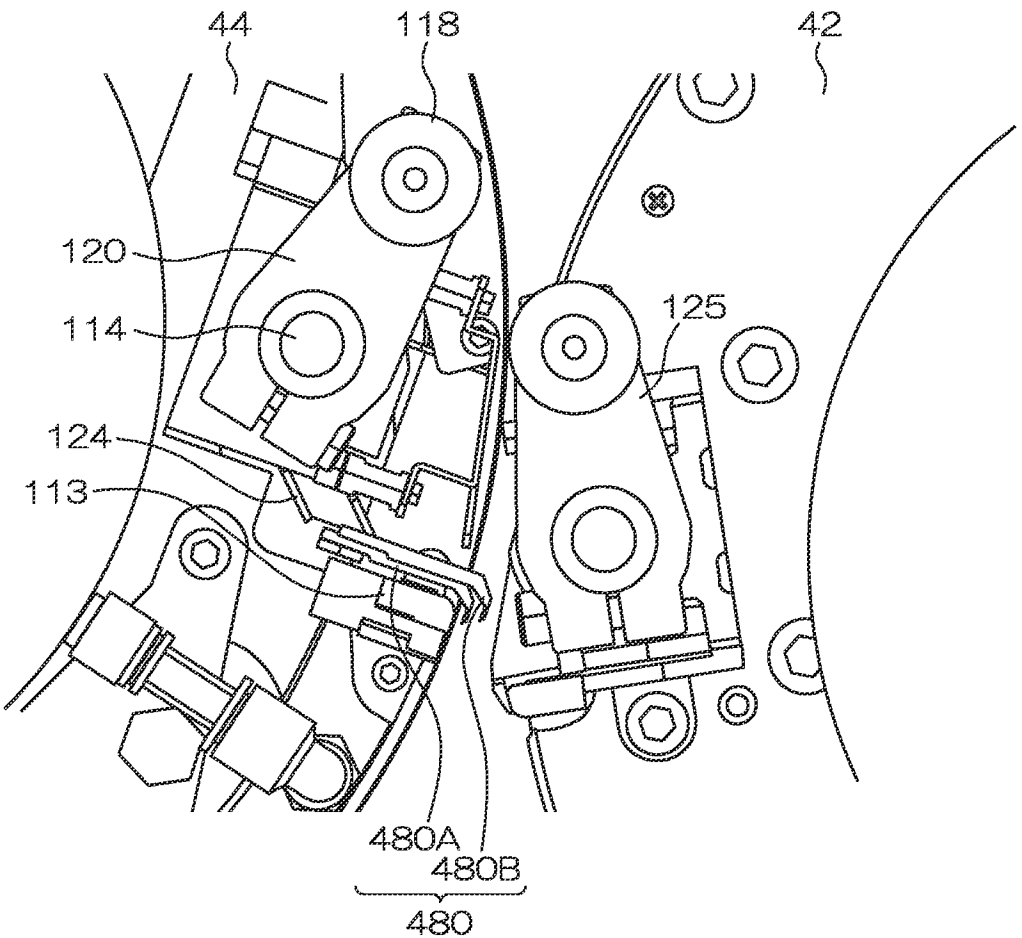
FIG. 17 is a diagram describing the operation of grippers during paper transfer in the composition of a second modification of the medium conveyance apparatus shown in FIG. 5.
Figure 18:
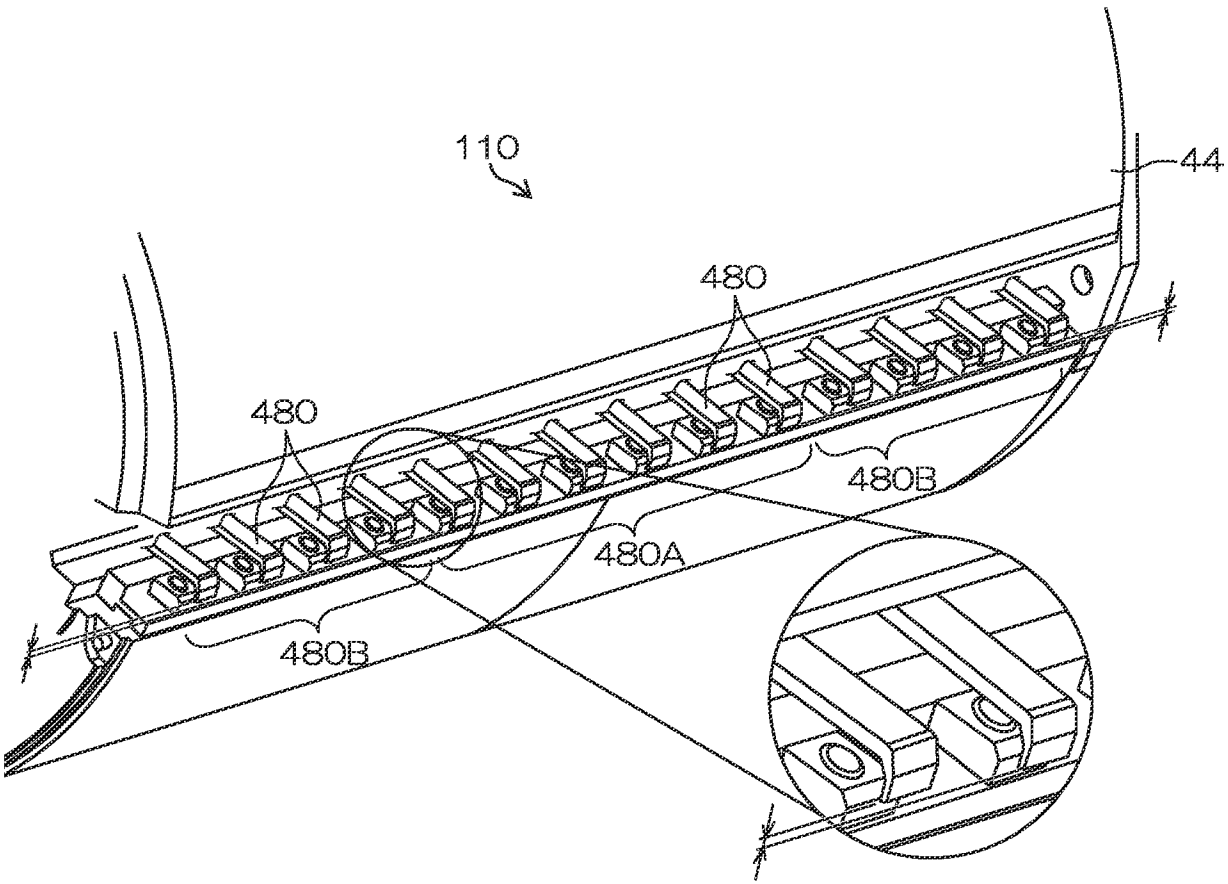
FIG. 18 is a perspective diagram of the image formation drum in FIG. 17.

FIG. 17 is a schematic drawing showing a state where grippers 480 have been opened in order to eliminate distortion of the recording medium 14, after the recording medium 14 has been transferred from the transfer drum 42 to the image formation unit 44, in a medium conveyance apparatus 450 according to the second modification of the embodiment. FIG. 18 is a perspective drawing of the image formation unit 44 shown in FIG. 17. Of the grippers 480 employed in the second modification, six grippers 480A in the central portion in the axial direction of the image formation unit 44 have a smaller amount of opening than four grippers 480B at either end (eight grippers 480B in total).

When the grippers 480A in the central portion and the grippers 480B in the respective end portions are opened after the recording medium 14 has been fastened by suction on the circumferential surface 104 of the image formation unit 44, the grippers 480A in the central portion have an amount of opening less than the thickness of the recording medium 14, and the grippers 480B in either end portion have an amount of opening exceeding the thickness of the recording medium 14.

By means of this composition, when the grippers 480A and 480B are opened in order to eliminate distortion of the recording medium 14, the gripping of either end portion of the recording medium 14 is released while maintaining the gripping of the central portion of the recording medium 14 in a slightly weakened state, and hence distortion which is liable to occur in either end portion of the recording medium 14 can be eliminated effectively, as well as preventing positional displacement of the recording medium 14 when eliminating the distortion of the recording medium 14. It is possible also to adopt a mode in which, when the grippers 480A in the central portion and the grippers 480B in the respective end portions are opened after the recording medium 14 has been fastened by suction on the circumferential surface 104 of the image formation unit 44, only the grippers 480B at either end portion are opened, and the grippers 480A in the central portion are left closed.

As an example of a structure in which the plurality of grippers 480 (480A and 480B) are opened and closed selectively, an opening and closing shaft 114 (see FIG. 3) that supports the grippers 480A in the central portion and an opening and closing shaft that supports the grippers 480B in each end portion are arranged, and the two opening and closing shafts are operated by separate drive mechanisms.

The "grippers in the central portion" in the present modification are the grippers which can impart a holding force on the recording medium 14 so as to prevent the occurrence of positional displacement of the recording medium 14, and include at least one of a "gripper arranged in the central portion of the image formation unit 44" and "two grippers which are arranged on either side of the central portion of the image formation unit 44". Furthermore, the "grippers in either end portion" include the grippers which do not belong to the grippers in the central portion, and include at least the grippers at either end of the image formation unit 44.

<Third Modification>

Figure 19:
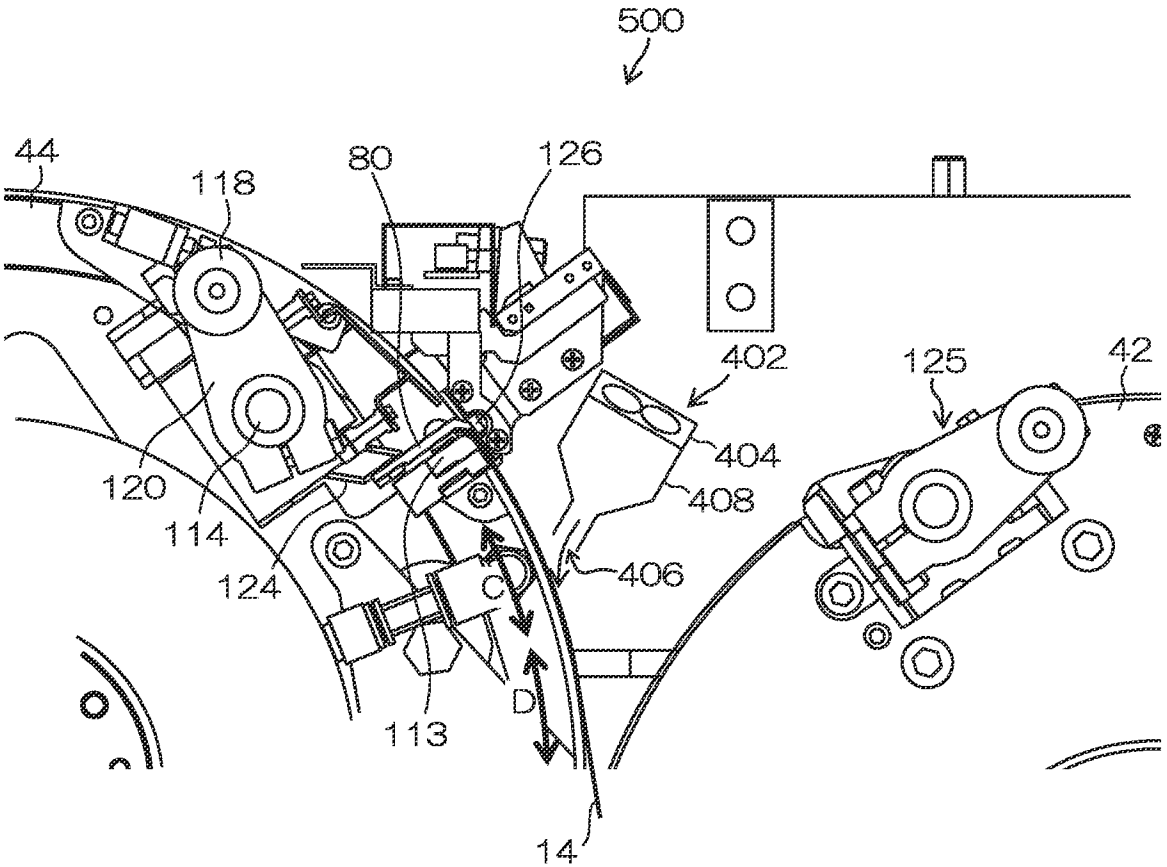
FIG. 19 is a diagram describing the operation during the release of paper in a third modification of the medium conveyance apparatus shown in FIG. 5.

FIG. 19 is a diagram showing the composition of a medium conveyance apparatus according to a third modification of the embodiment. The medium conveyance apparatus 500 shown in FIG. 19 is composed in such a manner that when the grippers 80 are opened in order to eliminate distortion of the recording medium 14, the suction pressure in the leading end portion of the recording medium 14 is weakened (or halted). A region indicated with a double-headed arrow C in FIG. 19 is a leading end suction region where the leading end portion of the recording medium 14 is fastened by suction, and a region indicated with a double-headed arrow D in FIG. 19 is a central suction region where the central portion of the recording medium 14 is fastened by suction.

For example, it is possible to perform the suction control in the leading end suction region and the suction control in the central suction region separately, by dividing the vacuum flow channel of the leading end suction region and the vacuum flow channel of the central suction region, as well as separately arranging a vacuum pump connected to the vacuum flow channel of the leading end suction region and a vacuum pump connected to the vacuum flow channel of the central suction region.

According to a composition of this kind, when the grippers 80 are opened in order to eliminate distortion in the recording medium 14, the suction pressure in the leading end portion of the recording medium 14 is weakened or halted, and therefore distortion can be eliminated through a broad range, in addition to which the suction in the central portion of the recording medium 14 is maintained and therefore the recording medium 14 is prevented from becoming detached from the image formation unit 44.

It is also possible to use a mode which suitably combines the compositions according to the first to third modifications described above. For example, if the second and third modifications are combined, then when the grippers 480B of each end portion in the axial direction of the image formation unit 44 are opened, the suction pressure at the positions corresponding to the grippers 480B is selectively weakened (or halted) and therefore it is possible to release more effectively any distortion occurring in the respective end portions of the leading end portion of the recording medium 14, and furthermore the suction pressure is maintained so as to prevent the occurrence of positional displacement of the recording medium 14.

Examples of Application to Other Apparatus Compositions

In the embodiments described above, the inkjet recording apparatus has been described as an example of the image forming apparatus, but the scope of application of the present invention is not limited to this, and may also be applied to an image forming apparatus based on a method other than an inkjet method, such as a laser recording method or electrophotographic method, or the like. For example, it is also possible to apply the present invention to color image recording apparatuses of various types, such as a thermal transfer recording apparatus equipped with a recording head that uses thermal elements as recording elements, an LED electrophotographic printer equipped with a recording head having LED elements as recording elements, or a silver halide photographic printer having an LED line type exposure head, or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

More specifically, the medium conveyance apparatus according to the present invention can be applied widely to compositions which require a processing unit that carries out prescribed processing on a recording medium and the recording medium that is the subject of processing to be situated in close proximity to each other, and which require contact between the processing unit and the medium to be avoided.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A medium conveyance apparatus, comprising:

a medium supporting device having a medium supporting surface which supports a rear surface of a medium opposite to a processing object surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to a processing region where a processing is performed to the processing object surface of the medium; and a control device which controls the gripping device in such a manner that after the gripping device has gripped the leading end portion of the medium and before the leading end portion of the medium arrives at the processing region, at least a part of the gripping device is temporarily opened and then after a prescribed time period has elapsed, the part of the gripping device having been opened is closed to grip the leading end portion of the medium again, wherein the fastening device includes a pressure application device which fastens the medium by applying pressure to the processing object surface of the medium, and the opening and the closing of the gripping device are carried out after the gripping device passes the pressure application device;

a medium detection device which detects floating up of the medium entering into the processing region at a detection region on an upstream side of the processing region in terms of the conveyance direction of the medium, wherein the control device controls the gripping device in such a manner that the part of the gripping device having been opened starts to be closed before entering into the detection region.

2. The medium conveyance apparatus as defined in claim 1, wherein the fastening device includes a suction fastening device which fastens the medium by suction by generating a negative pressure at the medium supporting surface.

3. The medium conveyance apparatus as defined in claim 1, wherein the gripping device includes a gripper having a structure that does not project outward beyond the medium supporting surface.

4. The medium conveyance apparatus as defined in claim 1, wherein the conveyance device includes a pressure drum of a cylindrical shape configured to be rotatable in a state where the medium is fastened on an outer circumferential surface of the cylindrical shape.

5. A medium conveyance apparatus, comprising:

a medium supporting device having a medium supporting surface which supports a rear surface of a medium opposite to a processing object surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to a processing region where a processing is performed to the processing object surface of the medium; and a control device which controls the gripping device in such a manner that after the gripping device has gripped the leading end portion of the medium and before the leading end portion of the medium arrives at the processing region, at least a part of the gripping device is temporarily opened and then after a prescribed time period has elapsed, the part of the gripping device having been opened is closed to grip the leading end portion of the medium again wherein the gripping device includes a plurality of grippers aligned in a widthwise direction of the medium which is perpendicular to the conveyance direction of the medium; and the control device controls the gripping device in such a manner that when the part of the gripping device is temporarily opened, an amount of opening of the gripper corresponding to substantially center of the recording medium in the widthwise direction is smaller than an amount of opening of the grippers corresponding to ends of the recording medium in the widthwise direction.

6. A medium conveyance apparatus, comprising:

a medium supporting device having a medium supporting surface which supports a rear surface of a medium opposite to a processing object surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to a processing region where a processing is performed to the processing object surface of the medium; and a control device which controls the gripping device in such a manner that after the gripping device has gripped the leading end portion of the medium and before the leading end portion of the medium arrives at the processing region, at least a part of the gripping device is temporarily opened and then after a prescribed time period has elapsed, the part of the gripping device having been opened is closed to grip the leading end portion of the medium again, wherein the control device controls the fastening device in such a manner that a fastening force of the fastening device acting on the recording medium is weakened while the part of the gripping device is being temporarily opened.

7. An image forming apparatus, comprising:

an image forming device which forms an image on an image forming surface of a medium;

a medium supporting device having a medium supporting surface which supports a rear surface of the medium opposite to the image forming surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to an image forming region where the image forming device forms the image on the image forming surface of the medium; and a control device which controls the gripping device in such a manner that after the gripping device has gripped the leading end portion of the medium and before the leading end portion of the medium arrives at the image forming region, at least a part of the gripping device is temporarily opened and then after a prescribed time period has elapsed, the part of the gripping device having been opened is closed to grip the leading end portion of the medium again, wherein the fastening device includes a pressure application device which fastens the medium by applying pressure to the processing object surface of the medium, and the opening and the closing of the gripping device are carried out after the gripping device passes the pressure application device;

a medium detection device which detects floating up of the medium entering into the processing region at a detection region on an upstream side of the processing in terms of the conveyance direction of the medium, wherein the control device controls the gripping device in such a manner that the part of the gripping device having been opened starts to be closed before entering into the detection region.

8. A medium conveyance method, comprising the steps of:

conveying a medium in a conveyance direction in a state where the medium is fastened;

gripping a leading end portion of the medium in terms of the conveyance direction in the conveying step;

fastening at least a portion of the medium other than the leading end portion of the medium of which the leading end portion is being gripped;

then releasing the gripping with respect to at least a part of the leading end portion of the medium which has been gripped; and then gripping the leading end portion of the medium again after a prescribed period of time has elapsed since the releasing in the releasing step, wherein the fastening device includes a pressure application device which fastens the medium by applying pressure to the processing object surface of the medium, and the opening and the closing of the gripping device are carried out after the gripping device passes the pressure application device;

detecting floating up of the medium entering into a processing region at a detection region on an upstream side of the processing region in terms of the conveyance direction of the medium, wherein the processing region is a region where a processing is performed to a processing object surface of the medium; and controlling the gripping device so as to start closing the part of the gripping device having been opened before the detection of floating up of the medium.

9. A medium conveyance apparatus, comprising:

a medium supporting device having a medium supporting surface which supports a rear surface of a medium opposite to a processing object surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to a processing region where a processing is performed to the processing object surface of the medium; and a control device which controls the gripping device in such a manner that after the gripping device has gripped the leading end portion of the medium and before the leading end portion of the medium arrives at the processing region, at least a part of the gripping device is temporarily opened and then after a prescribed time period has elapsed, the part of the gripping device having been opened is closed to grip the leading end portion of the medium again, wherein the fastening device includes a pressure application device which fastens the medium by applying pressure to the processing object surface of the medium, and the opening and the closing of the gripping device are carried out after the gripping device passes the pressure application device, and wherein the pressure application device is arranged at an upstream side of a medium detection device in terms of the conveyance direction of the medium, and the opening and the closing of the gripping device are carried out after the gripping device passes the pressure application device and before the gripping device enters into a detection region of the medium detection device.

10. An image forming apparatus, comprising:

an image forming device which forms an image on an image forming surface of a medium;

a medium supporting device having a medium supporting surface which supports a rear surface of the medium opposite to the image forming surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to an image forming region where the image forming device forms the image on the image forming surface of the medium; and a control device which controls the gripping device in such a manner that after the gripping device has gripped the leading end portion of the medium and before the leading end portion of the medium arrives at the image forming region, at least a part of the gripping device is temporarily opened and then after a prescribed time period has elapsed, the part of the gripping device having been opened is closed to grip the leading end portion of the medium again, wherein the fastening device includes a pressure application device which fastens the medium by applying pressure to the processing object surface of the medium, and the opening and the closing of the gripping device are carried out after the gripping device passes the pressure application device, wherein the pressure application device is arranged at an upstream side of a medium detection device in terms of the conveyance direction of the medium, and the opening and the closing of the gripping device are carried out after the gripping device passes the pressure application device and before the gripping device enters into the detection region of the medium detection device.

11. A medium conveyance method, comprising the steps of:

conveying a medium in a conveyance direction in a state where the medium is fastened;

gripping a leading end portion of the medium in terms of the conveyance direction in the conveying step;

fastening at least a portion of the medium other than the leading end portion of the medium of which the leading end portion is being gripped;

then releasing the gripping with respect to at least a part of the leading end portion of the medium which has been gripped; and then gripping the leading end portion of the medium again after a prescribed period of time has elapsed since the releasing in the releasing step, wherein the fastening device includes a pressure application device which fastens the medium by applying pressure to the processing object surface of the medium, and the opening and the closing of the gripping device are carried out after the gripping device passes the pressure application device, wherein the pressure application device is arranged at an upstream side of a medium detection device in terms of the conveyance direction of the medium, and the opening and the closing of the gripping device are carried out after the gripping device passes the pressure application device and before the gripping device enters into the detection region of the medium detection device.

12. A medium conveyance apparatus, comprising:

a medium supporting device having a medium supporting surface which supports a rear surface of a medium opposite to a processing object surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to a processing region where a processing is performed to the processing object surface of the medium; and a control device which controls the gripping device in such a manner that after the gripping device has gripped the leading end portion of the medium and before the leading end portion of the medium arrives at the processing region, at least a part of the gripping device is temporarily opened and then after a prescribed time period has elapsed, the part of the gripping device having been opened is closed to grip the leading end portion of the medium again;

a medium detection device which detects floating up of the medium entering into the processing region at a detection region on an upstream side of the processing region in terms of the conveyance direction of the medium, wherein the control device controls the gripping device in such a manner that the part of the gripping device having been opened starts to be closed before entering into the detection region.

13. An image forming apparatus, comprising:

an image forming device which forms an image on an image forming surface of a medium;

a medium supporting device having a medium supporting surface which supports a rear surface of the medium opposite to the image forming surface of the medium;

a gripping device which grips a leading end portion of the medium in terms of a conveyance direction of the medium;

a fastening device which fastens at least a non-gripped portion of the medium other than the leading end portion, the non-gripped portion being not gripped by the gripping device;

a conveyance device which conveys the medium held by at least one of the gripping device and the fastening device, in the conveyance direction to an image forming region where the image forming device forms the image on the image forming surface of the medium; and a control device which controls the gripping device in such a manner that after the gripping device has gripped the leading end portion of the medium and before the leading end portion of the medium arrives at the image forming region, at least a part of the gripping device is temporarily opened and then after a prescribed time period has elapsed, the part of the gripping device having been opened is closed to grip the leading end portion of the medium again;

a medium detection device which detects floating up of the medium entering into the processing region at a detection region on an upstream side of the processing region in terms of the conveyance direction of the medium, wherein the control device controls the gripping device in such a manner that the part of the gripping device having been opened starts to be closed before entering into the detection region.

14. A medium conveyance method, comprising the steps of:

conveying a medium in a conveyance direction in a state where the medium is fastened;

gripping a leading end portion of the medium in terms of the conveyance direction in the conveying step;

fastening at least a portion of the medium other than the leading end portion of the medium of which the leading end portion is being gripped;

releasing the gripping with respect to at least a part of the leading end portion of the medium which has been gripped;

gripping the leading end portion of the medium again after a prescribed period of time has elapsed since the releasing in the releasing step;

detecting floating up of the medium entering into a processing region at a detection region on an upstream side of the processing region in terms of the conveyance direction of the medium, wherein the processing region is a region where a processing is performed to a processing object surface of the medium; and controlling the gripping device so as to start closing the part of the gripping device having been opened before the detection of floating up of the medium.

* * * * *